US011565518B2

(12) United States Patent
Mu et al.

(10) Patent No.: US 11,565,518 B2
(45) Date of Patent: Jan. 31, 2023

(54) VOLTAGE DROP COMPENSATION FOR INKJET PRINTHEAD

(71) Applicant: SHANGHAI REALFAST DIGITAL TECHNOLOGY CO., LTD, Shanghai (CN)

(72) Inventors: Richard Mu, Irvine, CA (US); Yonglin Xie, Rochester, NY (US)

(73) Assignee: SHANGHAI REALFAST DIGITAL TECHNOLOGY, LTD., Shanghai (CN)

( * ) Notice: Subject to any disclaimer, the term of this patent is extended or adjusted under 35 U.S.C. 154(b) by 0 days.

(21) Appl. No.: 17/559,390

(22) Filed: Dec. 22, 2021

(65) Prior Publication Data

US 2022/0111640 A1 Apr. 14, 2022

Related U.S. Application Data

(62) Division of application No. 16/853,874, filed on Apr. 21, 2020, now Pat. No. 11,247,455.

(51) Int. Cl.
*B41J 2/045* (2006.01)

(52) U.S. Cl.
CPC ..... *B41J 2/04548* (2013.01); *B41J 2/0452* (2013.01); *B41J 2/0455* (2013.01); *B41J 2/0457* (2013.01); *B41J 2/04501* (2013.01); *B41J 2/04541* (2013.01)

(58) Field of Classification Search
CPC .. B41J 2/04548; B41J 2/04501; B41J 2/0452; B41J 2/04541; B41J 2/0455; B41J 2/0457; B41J 2/0458; B41J 2/14072
See application file for complete search history.

(56) References Cited

U.S. PATENT DOCUMENTS

| | | | | |
|---|---|---|---|---|
| 4,887,098 | A | 12/1989 | Hawkins et al. | |
| 5,144,341 | A | 9/1992 | El Hatem et al. | |
| 5,257,042 | A * | 10/1993 | Buhler | B41J 2/17566 347/58 |
| 5,469,203 | A | 11/1995 | Hauschild | |
| 5,497,174 | A | 3/1996 | Stephany et al. | |
| 6,398,347 | B1 | 6/2002 | Torgerson et al. | |
| 6,976,752 | B2 | 12/2005 | Parish et al. | |
| 8,757,778 | B2 | 6/2014 | Fricke et al. | |
| 2013/0201256 | A1 | 8/2013 | Fricke et al. | |

* cited by examiner

*Primary Examiner* — Geoffrey S Mruk
(74) *Attorney, Agent, or Firm* — Gary A. Kneezel

(57) ABSTRACT

A drop ejector array device includes a first plurality and a second plurality of drop ejectors that are alternatingly disposed along an array direction on the substrate surface. A voltage input terminal and a current return terminal are disposed on the substrate surface. A first power bus line connects the first plurality to the voltage input terminal. A second power bus line connects the second plurality to the voltage input terminal. The second power bus line is electrically connected to the first power bus line by a primary power bus connector line. A first current return bus line connects the first plurality to the current return terminal. A second current return bus line connects the second plurality to the current return terminal. The second current return bus line is electrically connected to the first current return bus line by a primary current return bus connector line.

3 Claims, 24 Drawing Sheets

FIG. 1 – PRIOR ART

VOLTAGE DROP COMPENSATION FOR INKJET PRINTHEAD

CROSS REFERENCE TO RELATED APPLICATIONS

This application is a divisional application of U.S. Pat. No. 11,247,422 filed Apr. 21, 2020.

FIELD OF THE INVENTION

This invention pertains to the field of inkjet printing and more particularly to providing a more uniform voltage to the drop ejector actuators on a printhead.

BACKGROUND OF THE INVENTION

Inkjet printing is typically done by either drop-on-demand or continuous inkjet printing. In drop-on-demand inkjet printing ink drops are ejected onto a recording medium using a drop ejector including a pressurization actuator (thermal or piezoelectric, for example). Selective activation of the actuator causes the formation and ejection of a flying ink drop that crosses the space between the printhead and the recording medium and strikes the recording medium. The formation of printed images is achieved by controlling the individual formation of ink drops, as is required to create the desired image.

Motion of the recording medium relative to the printhead during drop ejection can consist of keeping the printhead stationary and advancing the recording medium past the printhead while the drops are ejected, or alternatively keeping the recording medium stationary and moving the printhead. The former architecture is appropriate if the drop ejector array on the printhead can address the entire region of interest across the width of the recording medium. Such printheads are sometimes called pagewidth printheads. A second type of printer architecture is the carriage printer, where the printhead drop ejector array is somewhat smaller than the extent of the region of interest for printing on the recording medium and the printhead is mounted on a carriage. In a carriage printer, the recording medium is advanced a given distance along a medium advance direction and then stopped. While the recording medium is stopped, the printhead carriage is moved in a carriage scan direction that is substantially perpendicular to the medium advance direction as the drops are ejected from the nozzles. After the carriage-mounted printhead has printed a swath of the image while traversing the print medium, the recording medium is advanced; the carriage direction of motion is reversed; and the image is formed swath by swath.

A drop ejector in a drop-on-demand inkjet printhead includes a pressure chamber having an ink inlet for providing ink to the pressure chamber, and a nozzle for jetting drops out of the chamber. Two side-by-side drop ejectors are shown in prior art FIG. 1 (adapted from U.S. Pat. No. 7,163,278) as an example of a conventional thermal inkjet drop-on-demand drop ejector configuration. Partition walls 20 are formed on a base plate 10 and define pressure chambers 22. A nozzle plate 30 is formed on the partition walls 20 and includes nozzles 32 (also called orifices herein), each nozzle 32 being disposed over a corresponding pressure chamber 22. Ink enters pressure chambers 22 by first going through an opening in base plate 10, or around an edge of base plate 10, and then through ink inlets 24, as indicated by the arrows in FIG. 1. A heating element 35, which functions as the actuator, is formed on the surface of the base plate 10 within each pressure chamber 22. Heating element 35 is configured to selectively pressurize the pressure chamber 22 by rapid boiling of a portion of the ink in order to eject drops of ink through the nozzle 32 when an energizing pulse of appropriate amplitude and duration is provided.

Drop ejector array devices for inkjet printers, whether for pagewidth printers or for carriage printers, typically have hundreds of drop ejectors that are connected to a power bus that extends along the length of the drop ejector array. The power bus is connected at one or both ends to a voltage source. The drop ejectors are also connected (either directly or indirectly through driver transistors) to a common current return bus, which is typically connected at one or both ends to ground. Firing all drop ejectors in the array at the same time would require excessive instantaneous current. Firing only one drop ejector at a time would result in slow printing speeds. Typically, groupings of drop ejectors are enabled sequentially to print one grouping at a time. Each grouping requires only a short firing time and then has a rest period while the other groupings are sequentially fired before it is time to fire the grouping again. During the rest period, ink refills the pressure chambers of the ejectors that have been fired and resumes a sufficiently stable state for uniform drop ejection performance.

The power bus and the current return bus are made of an electrically conductive material such as aluminum. However, they are typically on the order of one to two microns thick. As a result, their resistance can be several ohms, which is not an insignificant fraction of the resistance of the heating element 35. The resistance in the bus lines is sometimes called parasitic resistance. When one or more actuators are fired, the current through the bus lines results in parasitic voltage drops. The amount of parasitic resistance between a given actuator and its connections to power and ground depend upon the position of the actuator in the array. The parasitic voltage drop for actuators of drop ejectors that are near an end of bus lines that are connected to power and ground is less than the parasitic voltage drop for actuators of drop ejectors that are farther from power and ground connections. In addition, the amount of current flowing through the bus lines (and therefore the magnitude of the parasitic voltage drop) depends upon how many drop ejectors are fired simultaneously. Print data can sometimes require one drop ejector in a grouping to be fired, or multiple drop ejectors in the grouping, or even the entire grouping at one time. The parasitic voltage drop due to bus line resistance thus depends upon the number of actuators that are fired as well as the location of the actuator or actuators along the drop ejector array.

Reliable drop ejection in a thermal inkjet printhead requires that the ink in each drop ejector to be fired is brought to rapid boiling in order to nucleate a vapor bubble that grows and expels the drop, regardless of the location of the drop ejectors or the number fired simultaneously. If the voltage provided to the power bus line is too small, only the drop ejectors that have smallest parasitic voltage drop will fire reliably. A threshold voltage can be defined as the voltage at which a drop ejector with the smallest parasitic voltage drop will reliably eject drops when fired without other drop ejectors firing. Typically the voltage (called an overvoltage) that is provided to the power bus for printing is somewhat greater than the threshold voltage. Excessive overvoltage can have adverse effects including increased power dissipation, drop nonuniformity, and damage to the heating elements. Drop ejectors at locations that are closer to the power and ground connections are more susceptible to excessive overvoltage, especially when fired one at a time, due to the lower parasitic voltage drop.

A variety of device designs have been disclosed in the prior art for compensating for variations in parasitic voltage drops in order to reduce the amount of overvoltage that is required to ensure that all drop ejectors can fire, even when multiple drop ejectors are fired at the same time. U.S. Pat. No. 4,887,098 discloses providing two common bus lines that are connected together with lines that pass between adjacent heating elements. The first common bus line and the second common bus line extend along opposite ends of the heating elements. Connection of the heating elements to the driver transistors is made by lines that cross over or under the second common bus line. U.S. Pat. No. 5,144,341 is similar to '098 but also includes a series ballast resistor disposed between the first power bus and the voltage input that the first power bus is connected to. The device design disclosed in U.S. Pat. No. 6,398,347 to compensate for the variation in parasitic resistances in the power bus lines uses configuring of the driver transistors to have differing on-resistances. For example, the on-resistance of the FET drivers is individually configured by the length of a continuously non-contacted segment of the drain region fingers. Alternatively, the on-resistance can be configured by varying the area of the FET driver transistors.

Other ways to compensate for variations in parasitic voltage drops disclosed in the prior art have included methods of operating the device. U.S. Pat. No. 5,497,174 discloses adjusting the duration of the pulse applied to the heating elements. For small parasitic voltage drops a shorter pulse duration is used, and for larger parasitic voltage drops a longer pulse duration is used. In this way the total energy provided to the heating elements is made more uniform. U.S. Pat. No. 5,469,203 discloses a similar approach using pulse count variation for compensating for parasitic voltage drops in a thermal printhead (not inkjet). U.S. Pat. No. 6,976,752 discloses associating a compensation circuit with each drop ejector where each compensation circuit includes a plurality of switches connected in parallel with each other. Internal resistance of the compensation circuits is adjusted by turning on more or fewer switches and thereby compensates for variations in parasitic resistance of the power lines depending, for example, on the number of drop ejectors to be fired at one time. U.S. Pat. No. 8,757,778 discloses using electronic circuitry to compensate for variations in parasitic voltage drops by monitoring ground potential and other supply-related voltages, and providing signals to affect the biasing of one or more transistors that couple the heating elements to supply voltage or ground.

Some of the ways of compensating for variations in parasitic voltage drops disclosed in the prior art are best suited for printheads where the drop ejectors to be fired at one time are proximate to one another on the printhead. For example, both '098 and '341 contemplate firing groups of adjacent drop ejectors at the same time. Compensation is provided such that, for firing groupings of four adjacent drop ejectors for example, the parasitic voltage drop for groupings near the middle of the array is made to be more similar to the parasitic voltage drop for groupings near the ends of the array. However, firing groupings of adjacent drop ejectors at the same time can result in undesirable fluidic cross-talk that affects drop ejection performance, and can require a longer rest time before the grouping of drop ejectors can be fired again. Other ways of compensating for variations in parasitic voltage drops can require additional area for implementation, thereby increasing the size and the cost of the drop ejector array device. For example, '347 requires varying the size of the driver transistors, and '752 requires the addition of many additional switches to the drop ejector array device. In addition, on-resistance of FET drivers, as disclosed in '347, can be difficult to control with sufficient accuracy. Similarly, ways of compensating for variations in parasitic voltage drops that rely on biasing of transistors, as disclosed in '778, can also be difficult to control with sufficient accuracy. Ways of compensating for variations in parasitic voltage drops based on varying the pulse count or pulse duration, as disclosed in '203 and '174, can result in a longer time to fire all of the drop ejectors, thereby limiting print speed. Ways of compensating for variations in parasitic voltage drops based on turning on more or fewer switches, as disclosed in '752, can result not only in a larger and higher cost drop ejector array device as noted above, but also can require increased data processing time.

Despite the previous advances in compensating for variations in parasitic voltage drops, what is still needed are drop ejector array device configurations and methods of operation that are effective in compensating for variations in parasitic voltage drops when the drop ejectors fired simultaneously are more widely spaced apart rather than being adjacent to one another. Furthermore, it is desired that such drop ejector array devices be compact, compatible with high speed printing with good drop ejection uniformity and long actuator lifetime, and not require additional input/output terminals on the drop ejector array device.

SUMMARY OF THE INVENTION

According to an aspect of the present invention, an inkjet printhead includes at least one drop ejector array device, where each drop ejector array device includes a substrate having a substrate surface, a first drop ejector array including a first plurality of drop ejectors disposed along an array direction on the substrate surface, and a second drop ejector array including a second plurality of drop ejectors. The first plurality and the second plurality of drop ejectors are alternatingly disposed along the array direction on the substrate surface. A voltage input terminal and a current return terminal are disposed on the substrate surface. A first power bus line is disposed on the substrate surface parallel to the array direction and connects the first plurality of drop ejectors to the voltage input terminal. A second power bus line is disposed on the substrate surface parallel to the array direction and connects the second plurality of drop ejectors to the voltage input terminal. The second power bus line is electrically connected to the first power bus line by a primary power bus connector line. A first current return bus line is disposed on the substrate surface parallel to the array direction and connects the first plurality of drop ejectors to the current return terminal. A second current return bus line is disposed on the substrate surface parallel to the array direction and connects the second plurality of drop ejectors to the current return terminal. The second current return bus line is electrically connected to the first current return bus line by a primary current return bus connector line.

According to another aspect of the present invention, a method is provided for operating an inkjet printhead having a first drop ejector array including m groups of n drop ejectors connected to a first power bus line and a second drop ejector array including m groups of n drop ejectors connected to a second power bus line, the first drop ejector array and the second drop ejector array being alternatingly disposed along an array direction. The method includes sending print data to the printhead and selectively firing according to the print data a first set of drop ejectors of the first drop ejector array, the first set of the first array having a single member of each group of drop ejectors of the first drop ejector array. Then a first set of drop ejectors of the second drop ejector array is selectively fired according to the print data, the first set of the second array having a single member of each group of drop ejectors of the second drop ejector array. Then a second set of drop ejectors of the first drop ejector array is selectively fired according to the print data, the second set of the first array having a different single member of each group of drop ejectors of the first drop ejector array. Then a second set of drop ejectors of the second drop ejector array is selectively fired according to the print data, the second set of the second array having a different single member of each group of drop ejectors of the second drop ejector array. The firing is continued as drop ejectors belonging to sets of drop ejectors of the first drop ejector array and the second drop ejector array are alternately selectively fired according to the print data until selective firing according to the print data of each drop ejector in all m groups in the first drop ejector array and the second drop ejector array has been completed.

This invention has the advantage that compensation for variations in parasitic voltage drops is provided for firing schemes in which the drop ejectors fired simultaneously can be spaced apart from each other by any distance including distances that are large compared to the spacing between adjacent drop ejectors. Further advantages are that the drop ejector array devices of the invention are compact, compatible with high speed printing with good drop ejection uniformity and long actuator lifetime, and do not require additional input/output terminals on the drop ejector array device.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 2:
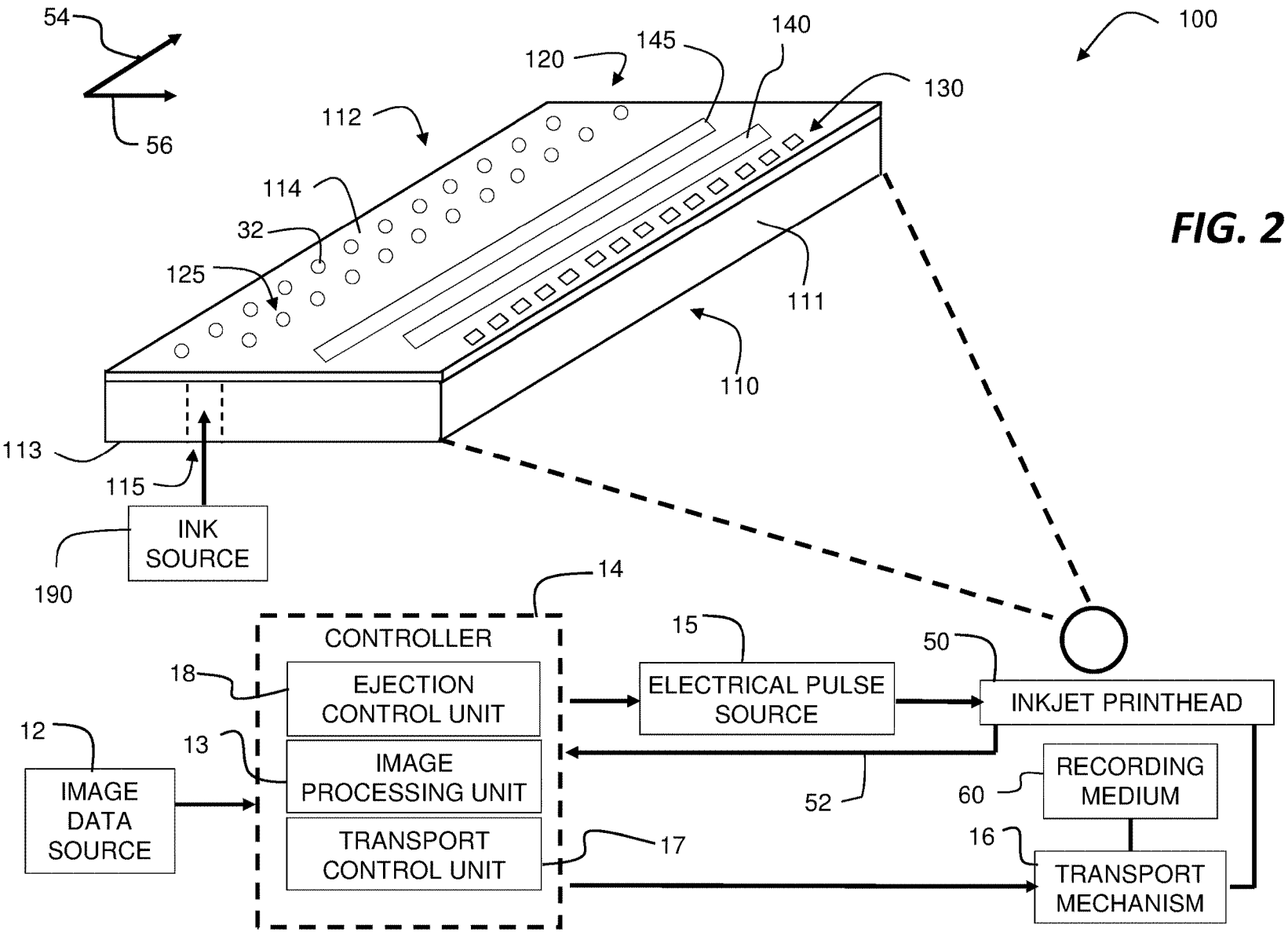
FIG. 2 shows a schematic representation of an inkjet printing system together with a perspective of drop ejector array device.

FIG. 2 shows a schematic representation of an inkjet printing system 100 together with a perspective of drop ejector array device 110. Image data source 12 provides image data signals that are interpreted by a controller 14 as commands for ejecting drops. Controller 14 includes an image processing unit 13 for rendering images for printing. The term "image" is meant herein to include any pattern of dots directed by the image data. It can include graphic or text images. It can also include patterns of dots for printing functional devices or three dimensional structures if appropriate inks are used. Controller 14 also includes a transport control unit 17 for controlling transport mechanism 16 and an ejection control unit 18 for ejecting ink drops to print a pattern of dots corresponding to the image data onto the recording medium 60. Controller 14 sends output signals to an electrical pulse source 15 for sending electrical pulse waveforms to an inkjet printhead 50 that includes at least one drop ejector array device 110. Sending the electrical pulse waveforms to the inkjet printhead 50 is also referred to herein as sending print data to the printhead. A printhead output line 52 is provided for sending electrical signals from the printhead 50 to the controller 14 or to sections of the controller 14, such as the ejection control unit 18. For example, printhead output line 52 can carry a temperature measurement signal from printhead 50 to controller 14. Transport mechanism 16 provides relative motion between inkjet printhead 50 and recording medium 60 along a scan direction 56. Transport mechanism 16 is configured to move the recording medium 60 along scan direction 56 while the printhead 50 is stationary in some embodiments. Alternatively, transport mechanism 16 can move the printhead 50, for example on a carriage, past stationary recording medium 60. Various types of recording media for inkjet printing include paper, plastic, and textiles. In a 3D inkjet printer, the recording media include a flat building platform and a thin layer of powder material. In addition, in various embodiments recording medium 60 can be web fed from a roll or sheet fed from an input tray.

Drop ejector array device 110 includes at least one drop ejector array 120 having a plurality of drop ejectors 125 formed on a top surface 112 of a substrate 111 that can be made of silicon or other appropriate material. Typically one or more thin film layers are deposited and patterned on the substrate 111 to form the drop ejectors and associated electronics. When it is said herein that the drop ejectors 125 or circuitry components are formed on the top surface 112, it is meant to include being formed on or in one or more of these thin film layers. In the example shown in FIG. 2, drop ejector array 120 includes a pair of rows of drop ejectors 125 that extend along array direction 54 and that are staggered with respect to each other in order to provide increased printing resolution.

Ink is provided to drop ejectors 125 by ink source 190 through ink feed 115 which extends from the back surface 113 of substrate 111 toward the top surface 112. Ink source 190 is generically understood herein to include any substance that can be ejected from an inkjet printhead drop ejector. Ink source 190 can include colored ink such as cyan, magenta, yellow or black. Alternatively ink source 190 can include conductive material, dielectric material, magnetic material, or semiconductor material for functional printing. Ink source 190 can alternatively include biological or other materials.

Figure 1:
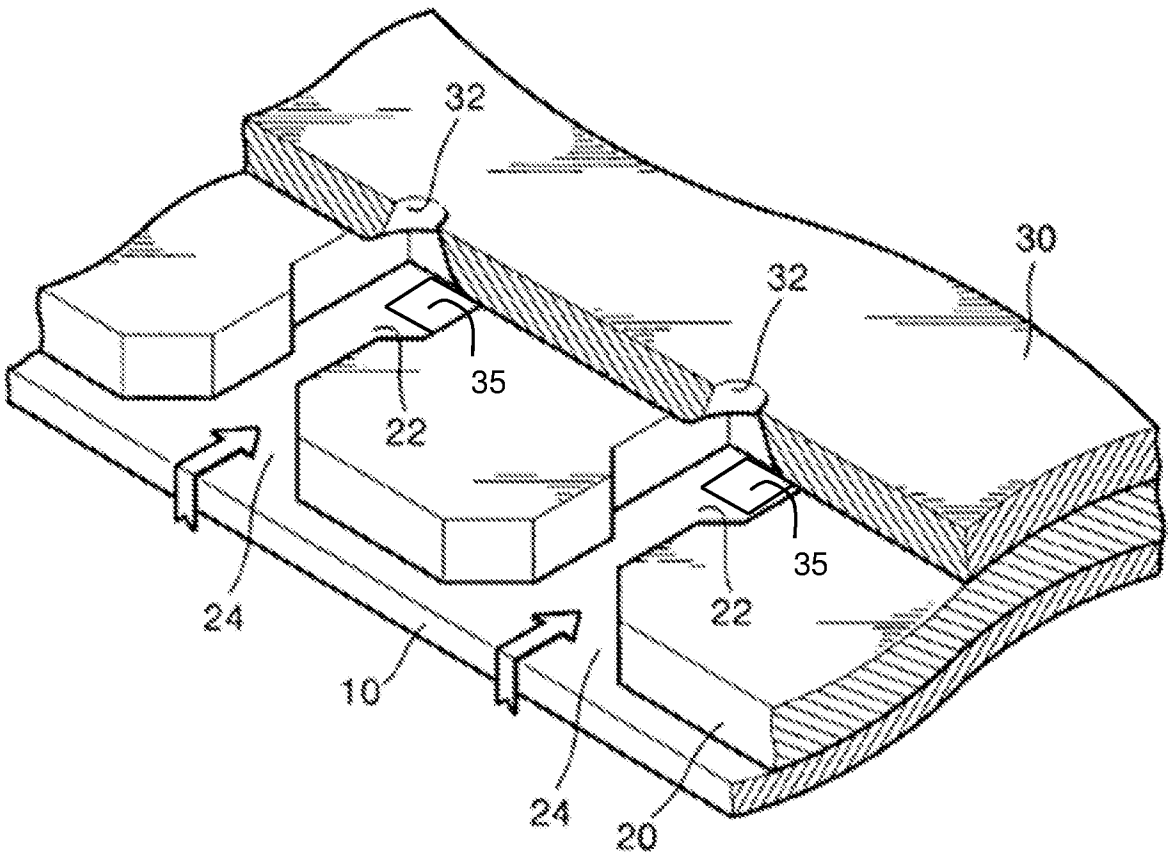
FIG. 1 shows a perspective of a prior art drop ejector configuration.

For simplicity, location of the drop ejectors 125 is represented by the circular nozzle 32. Nozzle face 114 is the exterior surface through which the nozzles 32 extend. Not shown in FIG. 2 are the pressure chamber 22, the ink inlet 24, or the actuator 35 (FIG. 1). Ink inlet 24 is configured to be in fluidic communication with ink source 190. The pressure chamber 22 is in fluidic communication with the nozzle 32 and the ink inlet 24. The actuator 35, e.g. a heating element or a piezoelectric element, is configured to selectively pressurize the pressure chamber 22 for ejecting ink through the nozzle 32.

Drop ejector array device 110 includes a group of input/output pads 130 for sending signals to and sending signals from drop ejector array module 110 respectively. Also provided on drop ejector array device 110 are logic circuitry 140 and driver circuitry 145. Logic circuitry 140 processes signals from controller 14 and electrical pulse source 15 and provides appropriate pulse waveforms at the proper times to driver circuitry 145 for actuating the drop ejectors 125 of drop ejector array 120 in order to print an image corresponding to data from image processing unit 13. When it is said herein that lines or circuit components are connected to drop ejectors, it is meant that they are connected to the actuators of the drop ejectors. Logic circuitry 140 sequentially selects one or more drop ejectors in the drop ejector array to be actuated. Different groupings of drop ejectors 125 in the drop ejector array are fired sequentially so that the capacities of the electrical pulse source 15 and the associated power leads are not exceeded. A grouping of drop ejectors 125 is fired during a print cycle. A stroke is defined as a plurality of sequential print cycles, such that during a stroke all of the drop ejectors 125 of drop ejector array 120 are addressed once so that they have opportunity to be fired once based upon the image data. Logic circuitry 140 can include circuit elements such as shift registers, gates and latches that are associated with inputs for functions including providing data, timing, and resets.

When a drop ejector is fired, some of the ink is pushed from the actuator toward the nozzle and is ejected toward the recording medium, but some of the ink is pushed backward away from the nozzle. If a grouping of drop ejectors that are fired simultaneously consists of drop ejectors that are spaced closely together, the ink that is pushed backward from each of the drop ejectors in the grouping can cause fluidic cross-talk that affects the performance of the neighboring drop ejectors, especially during refill of the pressure chambers. It is therefore advantageous for the groupings of simultaneously fired drop ejectors to consist of more widely spaced drop ejectors.

Figure 3:
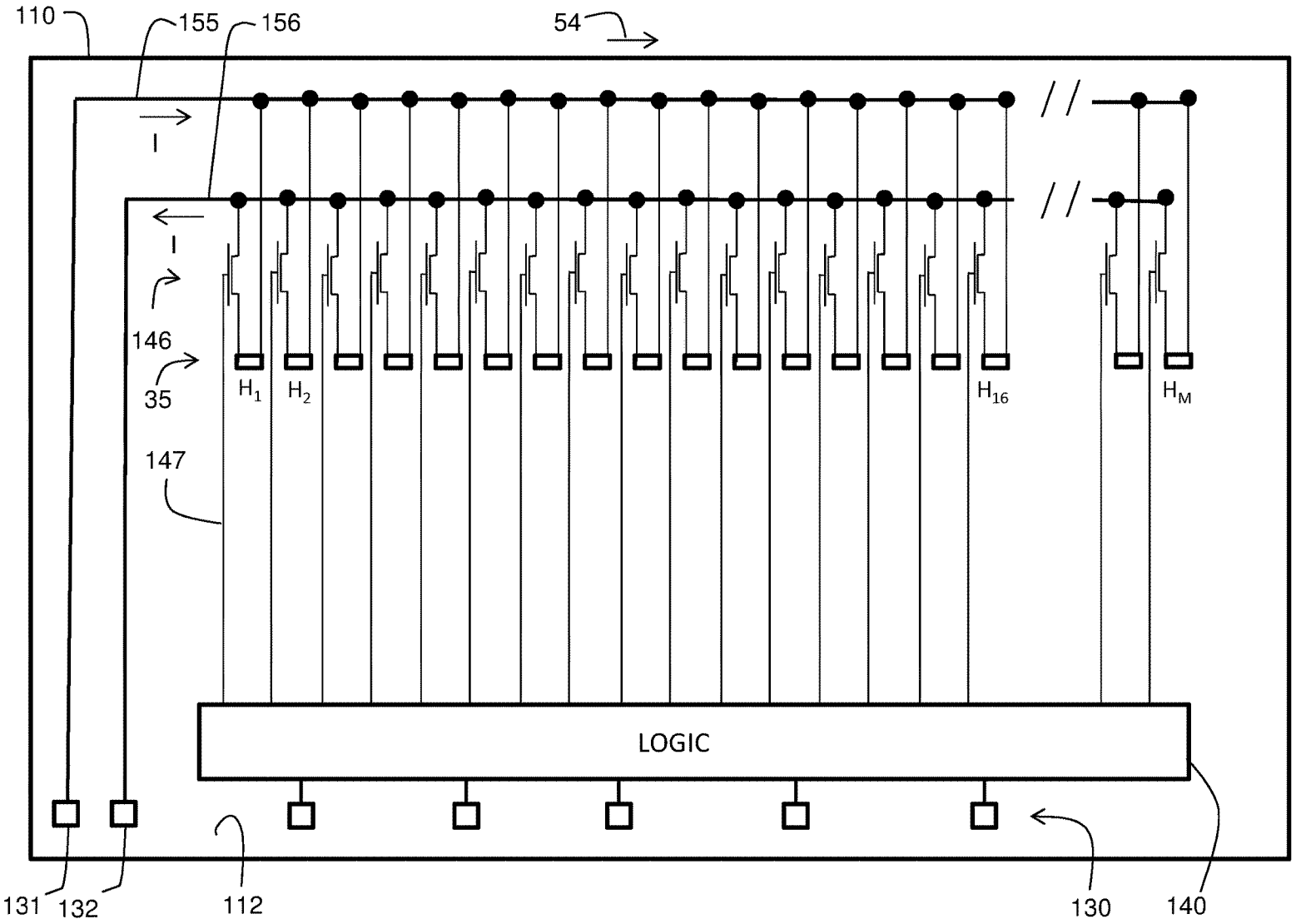
FIG. 3 shows a top view of a conventional drop ejector array device having drop ejectors disposed along an array direction.

FIG. 3 shows a top view of a conventional drop ejector array device 110 having a number M of drop ejectors disposed along the array direction 54 on the top surface 112 of the drop ejector array device 110. Also shown is associated circuitry formed on the top surface 112 of the drop ejector array device 110. In this example the actuators are heating elements 35. A power bus line 155 is connected to a voltage input terminal 131 and provides power to all of the M heating elements $H_1$ to $H_M$. Driver transistors 146 are connected to each of the M heating elements for selectively turning power on and off to fire the corresponding drop ejector. A current return bus line 156 is connected to a current return terminal 132. Typically the current return terminal is connected to ground. The gate lines 147 of the driver transistors 146 are connected to the logic circuitry 140. Other input/output pads 130 are provided for connection to the logic circuitry 140.

For purposes of comparison a series of examples will be described where the number M of drop ejectors equals 160. In these examples, the 160 drop ejectors are configured as m=5 groups of n=32 drop ejectors. The 32 drop ejectors in each group are proximate to one another. The first group includes heating elements $H_1$ to $H_{32}$ and is nearest to the voltage input terminal and the current return terminal. The fifth group includes heating elements $H_{129}$ to $H_{160}$ and is farthest from the voltage input terminal and the current return terminal. Up to five heating elements can be fired at the same time in these examples, one from each group. For example, during a first print cycle in a stroke, heating elements $H_1$, $H_{33}$, $H_{65}$, $H_{97}$ and $H_{129}$ are fired, or more generally, the first heating element in each group is addressed for firing according to the image data. During a second print cycle in a stroke, heating elements $H_2$, $H_{34}$, $H_{66}$, $H_{98}$, and $H_{130}$ are fired, or more generally, the second heating element in each group is addressed for firing according to the image data. During the thirty-second print cycle in a stroke, heating elements $H_{32}$, $H_{64}$, $H_{96}$, $H_{128}$, and $H_{160}$, or more generally in a last print cycle in a stroke, the last heating element in each group is addressed for firing according to the image data.

Figure 4:
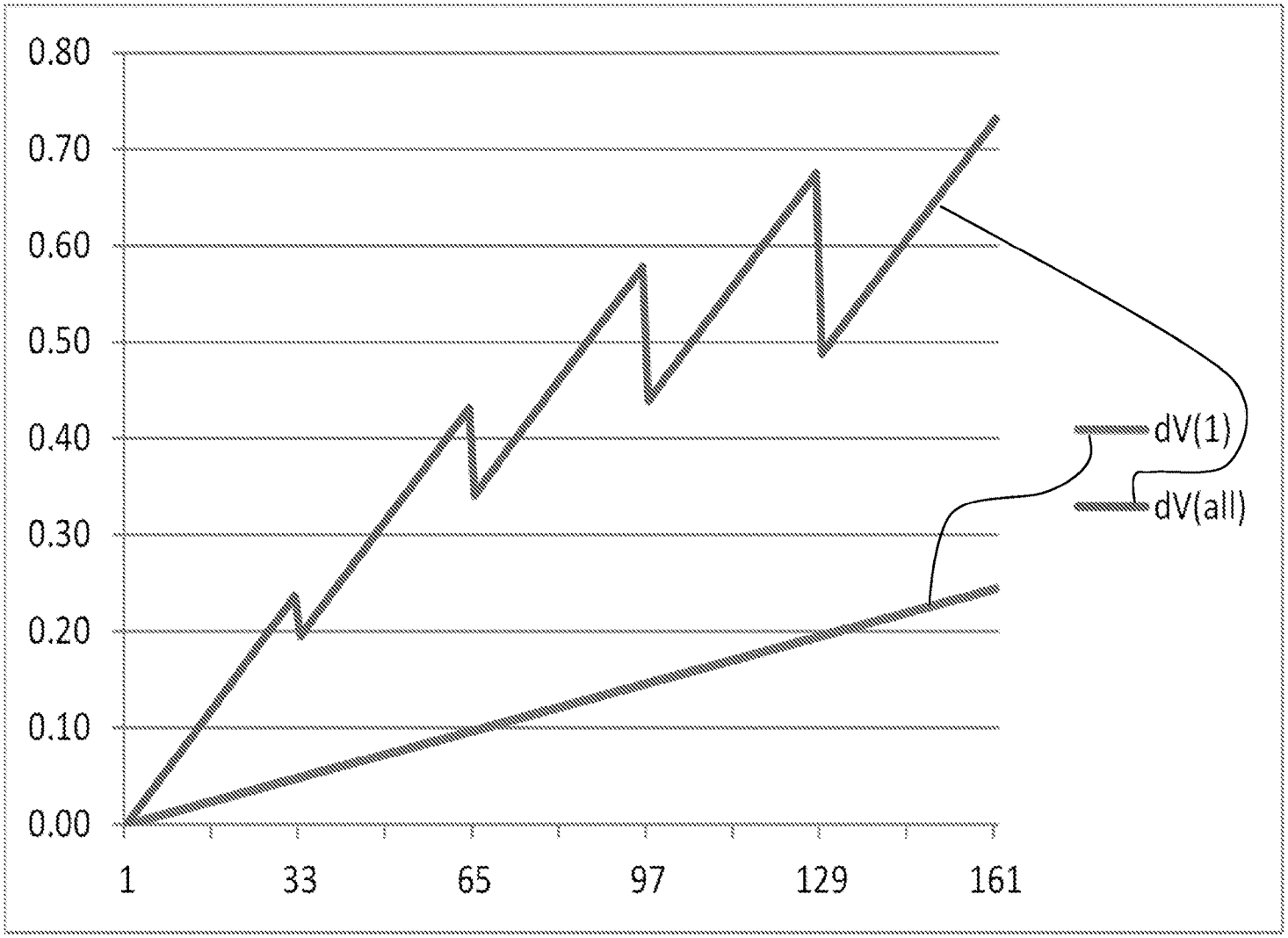
FIG. 4 shows the resulting variation in parasitic voltage drop for the conventional drop ejector array device of FIG. 3.

FIG. 4 shows the resulting variation in parasitic voltage drop for the conventional drop ejector array device of FIG. 3 where M=160 and the drop ejectors are fired in 32 print cycles with up to 5 drop ejectors fired per print cycle as described above. Curve dV(1) shows the parasitic voltage drop as a function of position of the drop ejector in the array for the case of firing only one drop ejector at a time. Curve dV(all) shows the parasitic voltage drop as a function of position of the drop ejector in the array for the case of firing five drop ejectors at a time, one from each group. For firing one drop ejector at a time, the linear increase in parasitic voltage drop as a function of position shown in curve dV(1) is due to the increasing amount of parasitic resistance in the power bus line 155 (FIG. 3) and the current return bus 156 for heating elements 35 that are farther from the voltage input terminal 131 and the current return terminal 132. The parasitic voltage drop for heating element 160 is about 0.25 voltage units higher than the parasitic voltage drop for heating element 1 when fired one drop ejector at a time. For firing five drop ejectors at a time, one from each group, the increase in parasitic voltage drop as a function of position shown in curve dV(all) is nonlinear and is greater in magnitude than for firing one drop ejector at a time. When the set of drop ejectors farthest from the voltage input terminal 131 and the current return terminal 132 (i.e. $H_{32}$, $H_{64}$, $H_{96}$, $H_{128}$, and $H_{160}$) is fired, the parasitic voltage drop is about 0.73 voltage units higher than the parasitic voltage drop for heating element 1. As a result, an overvoltage of at least 0.73 voltage units higher than the threshold voltage is required in order to ensure that this set of drop ejectors farthest from the voltage input terminal 131 and the current return terminal 132 will fire reliably. Since the voltage at the voltage input terminal is typically constant, this means that heating element $H_1$ will have 0.73 voltage units more than is needed for ejecting a drop when it is fired alone. For drop ejector array devices having more than 160 heating elements and more drop ejectors fired simultaneously, the maximum parasitic voltage drop will be even larger.

The jagged shape of curve dV(all) illustrates the effect of not only the position of the heating elements, but also which heating elements are fired together. For each group of heating elements the parasitic voltage drop increases monotonically, but at the border between groups there is an abrupt decrease in the parasitic voltage drop. For example, the parasitic voltage drop for $H_{32}$ when fired together with all of the other members in its set is about 0.22 voltage units, but the parasitic voltage drop of the next further heating element $H_{33}$ is about 10% less. The change in parasitic voltage drop between $H_{128}$ (0.68 voltage units) and $H_{129}$ (0.49 voltage units) is even larger at nearly 30%. A large change in parasitic voltage drop between adjacent drop ejectors can present additional problems if it results in ejection of different sized drops of ink resulting in abrupt changes in spot size. In addition, adjacent spots on the printed page can be printed by nonadjacent drop ejectors on a drop ejector array device. For example, in a pagewidth printhead having a plurality of drop ejector array devices 110 arranged end-to-end in an aligned or staggered fashion (see FIG. 27), a spot can be printed by $H_1$ of one drop ejector array device and a neighboring spot can be printed by $H_M$ of an adjacent drop ejector array device, and the two corresponding actuators can have significantly different voltages due to different parasitic voltage drops.

Excessive amounts of overvoltage can make drop ejection nonuniform and can also damage heating elements over a period of time. Power is proportional to the square of the voltage. The percent overvoltage, i.e. the overvoltage divided by the input voltage is a useful metric. If the percent overvoltage is 10%, then the power dissipated in the heating element $H_1$ fired by itself will be about 21% higher than the power dissipated in the last set of drop ejectors when fired simultaneously. Different amounts of power dissipation in the heating elements result in different temperature heating rates. When the heating element reaches a sufficiently high temperature a bubble is nucleated and begins to grow. Once the bubble has grown to the extent that liquid ink is no longer in contact with the heating element, transfer of heat into the ink is dramatically reduced. As a result, too fast of a temperature increase (corresponding to higher power dissipation) can result in less heating of the ink in the pressure chamber, which can lead to smaller drop size. In addition, once the vapor bubble has isolated the heating element from the ink, there is less cooling of the heating element, so that the temperature of the heating element rises excessively. This can result in gradual degradation of the heating element due to baking on of ink residue, or it can cause resistance changes in the heating element, or even catastrophic failure of the heating element.

It is not necessary to completely eliminate variations in parasitic voltage drops, but merely to reduce the variation to a percent overvoltage that does not result in excessive variation in ink drop size or other ejection performance attributes or in degradation of heating elements. Several embodiments of the invention are described below that result in a smaller amount of parasitic voltage drop variation.

Figure 5:
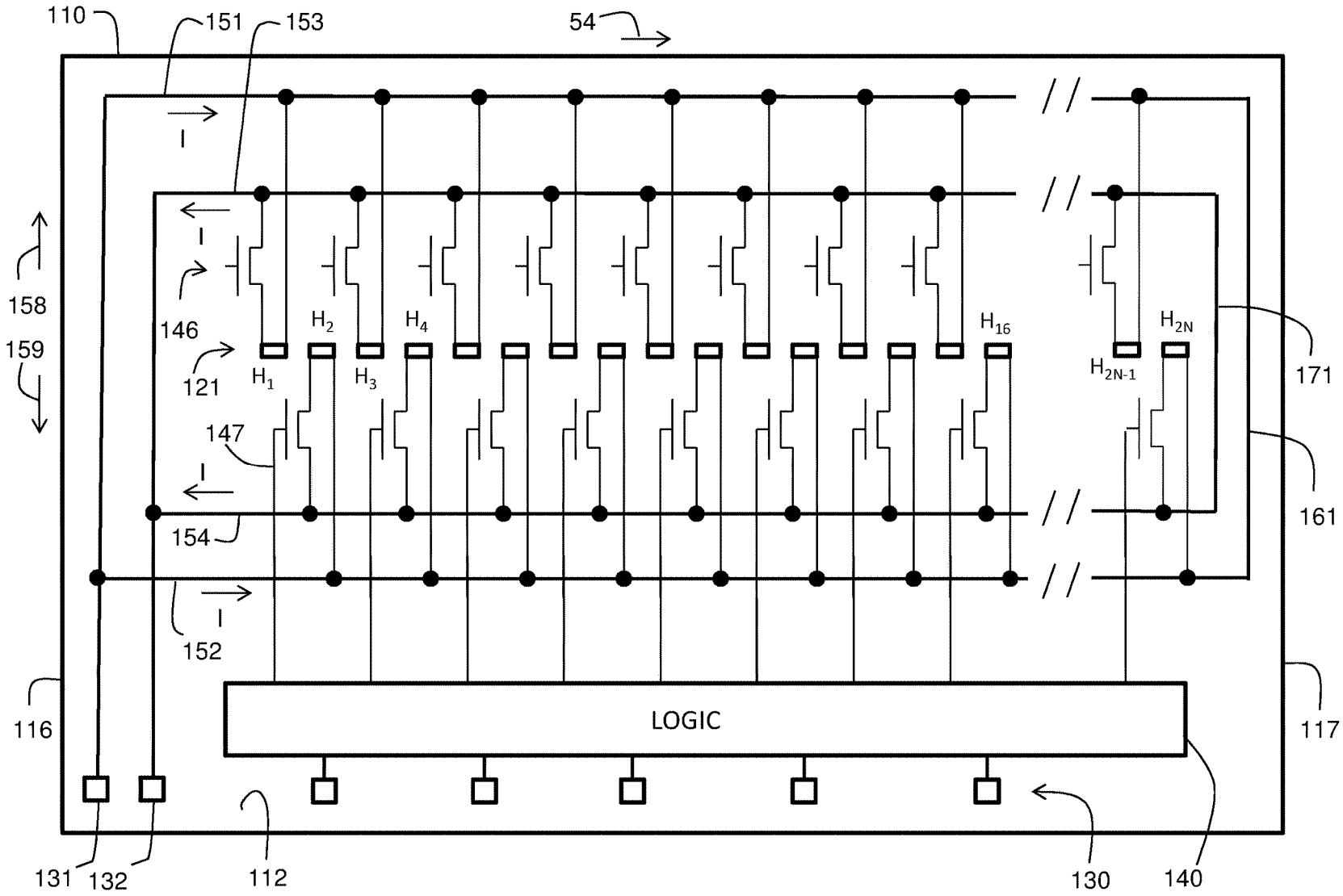
FIG. 5 shows a top view of a drop ejector array device having drop ejectors disposed in alternating arrays along an array direction and connected to power bus lines and current return bus lines according to an embodiment of the invention.

FIG. 5 shows a top view of a drop ejector array device 110 having a number 2N of drop ejectors disposed along the array direction 54 on the top surface 112 of the drop ejector array device 110 according to a first embodiment of the invention. Drop ejector array device 110 has a pair of drop ejector arrays 121 including a first drop ejector array that includes a first plurality of drop ejectors, i.e. odd-numbered drop ejectors $H_1$, $H_3$, . . . $H_{2N-1}$; and a second drop ejector array that includes a second plurality of drop ejectors, i.e. even-numbered drop ejectors $H_2$, $H_4$, . . . $H_{2N}$. The first plurality of drop ejectors and the second plurality of drop ejectors are alternatingly disposed along the array direction 54 on the substrate top surface 112. The terms first drop ejector array and first plurality of drop ejectors are used interchangeably herein, as are the terms second drop ejector array and second plurality of drop ejectors. A voltage input terminal 131 and a current return terminal 132 are disposed on the top surface 112 proximate to a first side edge 116 of the drop ejector array device 110. A first power bus line 151 is disposed on the substrate top surface 112 parallel to the array direction 54 and connects the first plurality of drop ejectors, i.e. the odd-numbered drop ejectors to the voltage input terminal 131. A second power bus line 152 is disposed on the substrate top surface 112 parallel to the array direction and connects the second plurality of drop ejectors, i.e. the even-numbered drop ejectors to the voltage input terminal 131. The second power bus line 152 is electrically connected to the first power bus line 151 by a primary power bus connector line 161 that is proximate to a second side edge 117 that is opposite to the first side edge 116 of the drop ejector array device 110. A first current return bus line 153 is disposed on the substrate top surface 112 parallel to the array direction 54 and connects the first plurality of drop ejectors to the current return terminal 132. A second current return bus line 154 is disposed on the substrate top surface 112 parallel to the array direction 54 and connects the second plurality of drop ejectors to the current return terminal 132. The second current return bus line 154 is electrically connected to the first current return bus line 153 by a primary current return bus connector line 171 that is proximate to a second side edge 117 that is opposite to the first side edge 116 of the drop ejector array device 110. When it is said herein that the drop ejectors are connected to a power bus line or a current return bus line, it is understood to mean that they are either directly connected as the drop ejectors are connected to the power bus lines 151 and 152 in FIG. 5, or indirectly connected, for example through a driver transistor 146 as the drop ejectors are connected to the current return bus lines 153 and 154 in FIG. 5. In some advantageous embodiments the width and length of the primary power bus line are chosen such that the resistance of the primary power bus connector line 161 is lower than the resistances of the first power bus line 151 and the second power bus line 152. In some advantageous embodiments the width and length of the primary current return bus line are chosen such that the resistance of the primary current return bus connector line 171 is lower than the resistances of the first current return bus line 153 and the second current return bus line 154.

Gate lines 147 for the driver transistors 146 connected to the second plurality of drop ejectors are shown in FIG. 5, i.e. the even-numbered drop ejectors, but for simplicity the gate lines are not shown for the driver transistors that are connected to the first plurality of drop ejectors, i.e. the odd-numbered drop ejectors.

In the example shown in FIG. 5, the first power bus line 151 is offset from the first drop ejector array, i.e. the odd-numbered drop ejectors, in a first direction 158. The second power bus line 152 is offset from the second drop ejector array, i.e. the even-numbered drop ejectors, in a second direction 159 that is opposite to the first direction 158. The first current return bus line 153 is offset from the first drop ejector array in the first direction 158 and is disposed between the first power bus line 151 and the first drop ejector array. Alternatively, the first power bus line 151 can be disposed between the first current return bus line 153 and the first drop ejector array (see FIG. 8). Also in the example shown in FIG. 5, the second current return bus line 154 is offset from the second drop ejector array in the second direction 159 and is disposed between the second power bus line 152 and the second drop ejector array. Alternatively, the second power bus line 152 can be disposed between the second current return bus line 154 and the second drop ejector array (see FIG. 8).

In the example shown in FIG. 5, logic circuitry 140 for drive transistors 146 associated with the even-numbered drop ejectors is disposed parallel to the pair of drop ejector arrays 121 and offset from the pair of drop ejector arrays 121 in the second direction 159. Logic circuitry 140 for drive transistors 146 associated with the odd-numbered drop ejectors (not shown) is disposed parallel to the pair of drop ejector arrays 121 and offset from the pair of drop ejector arrays 121 in the first direction 158. The group of input/output pads 130 corresponds to logic circuitry 140 for drive transistors 146 associated with the even-numbered drop ejectors are disposed parallel to the pair of drop ejector arrays 121 and offset from the logic circuitry 140 in the second direction 159. The group of input/output pads 130 corresponds to logic circuitry 140 for drive transistors 146 associated with the odd-numbered drop ejectors (not shown) are disposed parallel to the pair of drop ejector arrays 121 and offset from the logic circuitry 140 in the first direction 158.

In an alternative example (not shown), the group of input/output pads 130, the voltage input terminal 131, and the current return terminal 132 are disposed along the first the direction 158 and proximate to the first side edge 116 of drop ejector array device 110.

Figure 9:
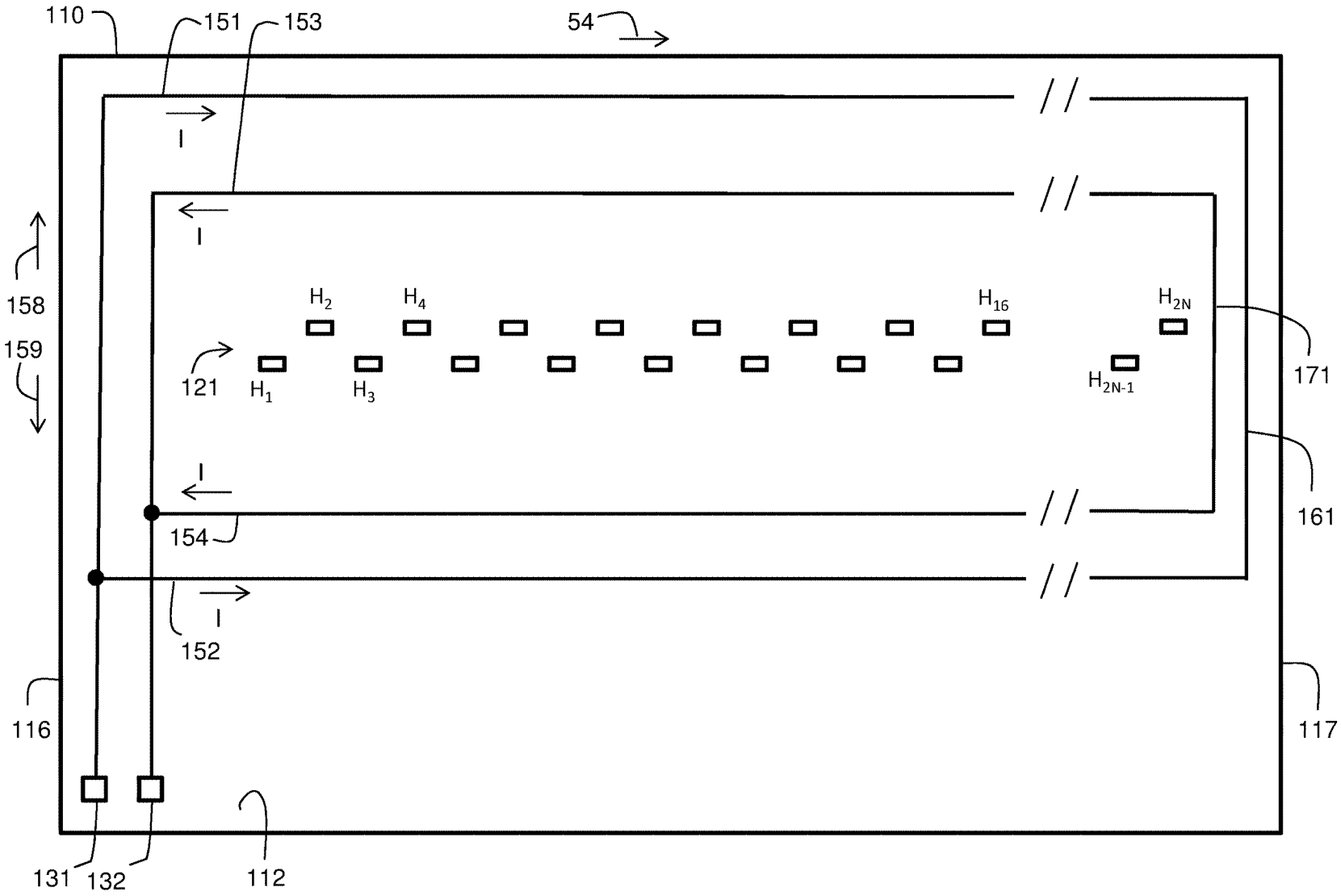
FIG. 9 shows another embodiment having a different configuration.

In the example shown in FIG. 5 the first plurality of drop ejectors, i.e. the odd-numbered drop ejectors are aligned with the second plurality of drop ejectors, i.e. the even-numbered drop ejectors, along the array direction 54. In other embodiments the first plurality of drop ejectors can be offset from the second plurality of drop ejectors along the first direction to provide a staggered configuration of the pair of drop ejector arrays 121 as shown in FIG. 9.

Figure 6:
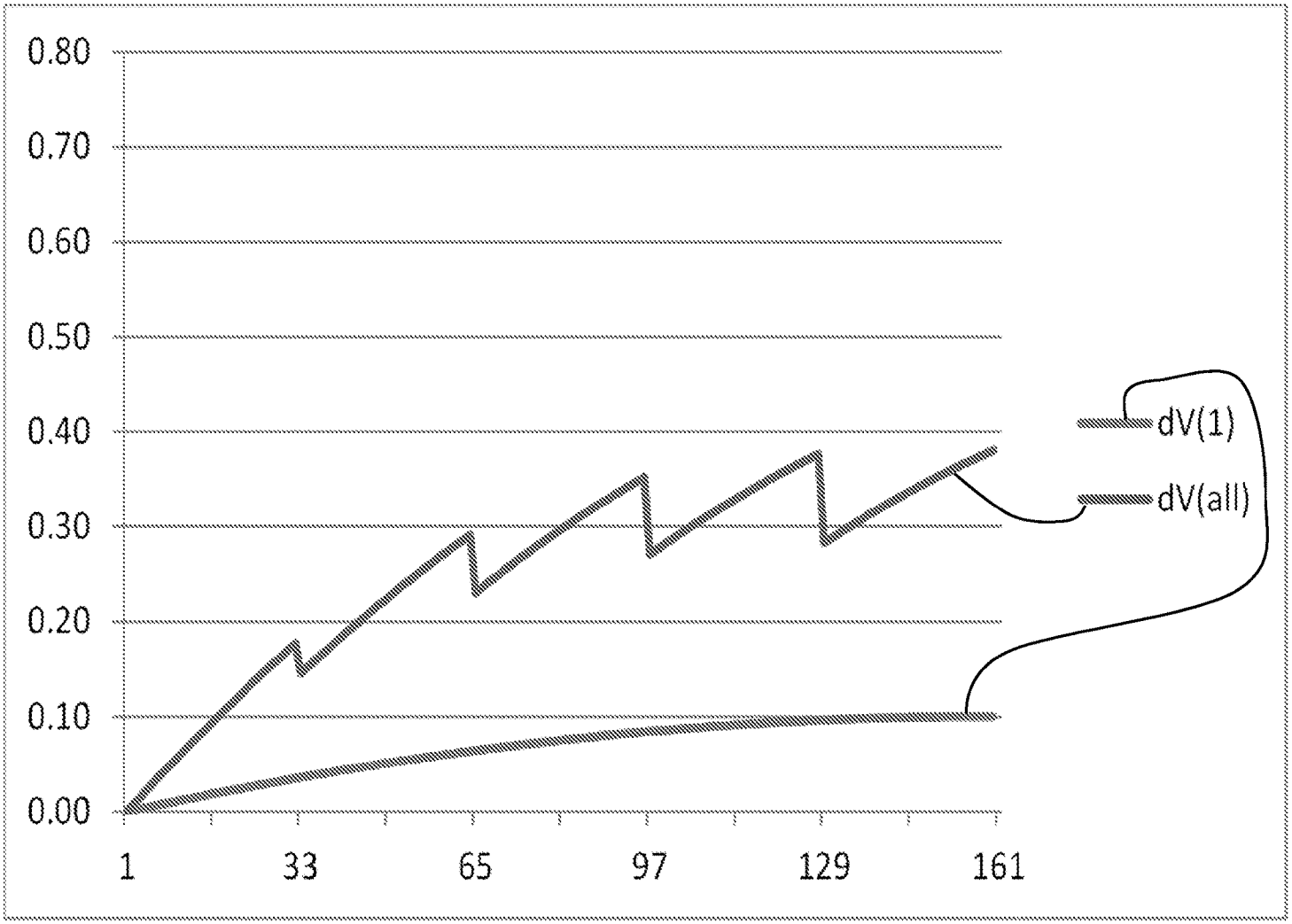
FIG. 6 shows the resulting variation in parasitic voltage drop for a drop ejector array device similar to that shown in FIG. 5.

FIG. 6 shows the resulting variation in parasitic voltage drop for the drop ejector array device of FIG. 5 where 2N=160 and the drop ejectors are fired in 32 print cycles with up to five drop ejectors fired per print cycle. Comparing the dV(1) curves of FIGS. 4 and 6 it can be seen that the embodiment shown in FIG. 5 results in a decrease in the variation in parasitic voltage drop by about a factor of two as a function of position when firing one drop ejector at a time. Similarly, comparing the dV(all) curves of FIGS. 4 and 6 it can also be seen that the embodiment shown in FIG. 5 results in a decrease in the variation in parasitic voltage drop by about a factor of two when firing sets of five drop ejectors at the same time in each print cycle.

The firing order corresponding to the results shown in FIG. 6 is now described. In a first print cycle either one drop ejector (corresponding to dV(1)) or all five drop ejectors (corresponding to dV(all)) of the first set of odd-numbered drop ejectors $H_1$, $H_{33}$, $H_{65}$, $H_{97}$, $H_{129}$ are fired. Then in a second print cycle either one drop ejector or all five drop ejectors of the first set of even-numbered drop ejectors $H_2$, $H_{34}$, $H_{66}$, $H_{98}$, $H_{130}$ are fired. Then in a third print cycle either one drop ejector or all five drop ejectors of the second set of odd-numbered drop ejectors $H_3$, $H_{35}$, $H_{67}$, $H_{99}$, $H_{131}$ are fired. Then in a fourth print cycle either one drop ejector or all five drop ejectors of the second set of even-numbered drop ejectors $H_4$, $H_{36}$, $H_{68}$, $H_{100}$, $H_{132}$ are fired. In successive print cycles sets of odd-numbered drop ejectors and even-numbered drop ejectors are alternately fired until the printing stroke is completed in the thirty second print cycle when $H_{32}$, $H_{64}$, $H_{96}$, $H_{128}$ and $H_{160}$ are selectively fired. Note that in this example, the firing order moves in order from left to right across the alternating sets of odd-numbered and even-numbered drop ejectors. However, it is also contemplated in other embodiments that other firing orders alternating between sets of odd-numbered and even-numbered drop ejectors can be used.

More generally, the method of operating an inkjet printhead to fire a printing stroke described above with reference to FIGS. 5 and 6 can be described as follows for a first drop ejector array including m groups of n drop ejectors connected to a first power bus line 151 and a second drop ejector array including m groups of n drop ejectors connected to a second power bus line 152, the first drop ejector array and the second drop ejector array being alternatingly disposed along an array direction 54: During a first print cycle a first set of drop ejectors of the first drop ejector array that has a single member of each group of drop ejectors of the first drop ejector array are selectively fired. During a second print cycle a first set of drop ejectors of the second drop ejector array that has a single member of each group of drop ejectors of the second drop ejector array are selectively fired. During a third print cycle a second set of drop ejectors of the first drop ejector array that has a different single member of each group of drop ejectors of the first drop ejector array are selectively fired. During a fourth print cycle a second set of drop ejectors of the second drop ejector array that has a different single member of each group of drop ejectors of the second drop ejector array are selectively fired. In subsequent print cycles the drop ejectors that are selectively fired alternately belong to sets of drop ejectors of the first drop ejector array and the second drop ejector array until selective firing of each drop ejector in all m groups in the first drop ejector array and the second drop ejector array has been completed.

Figure 7:
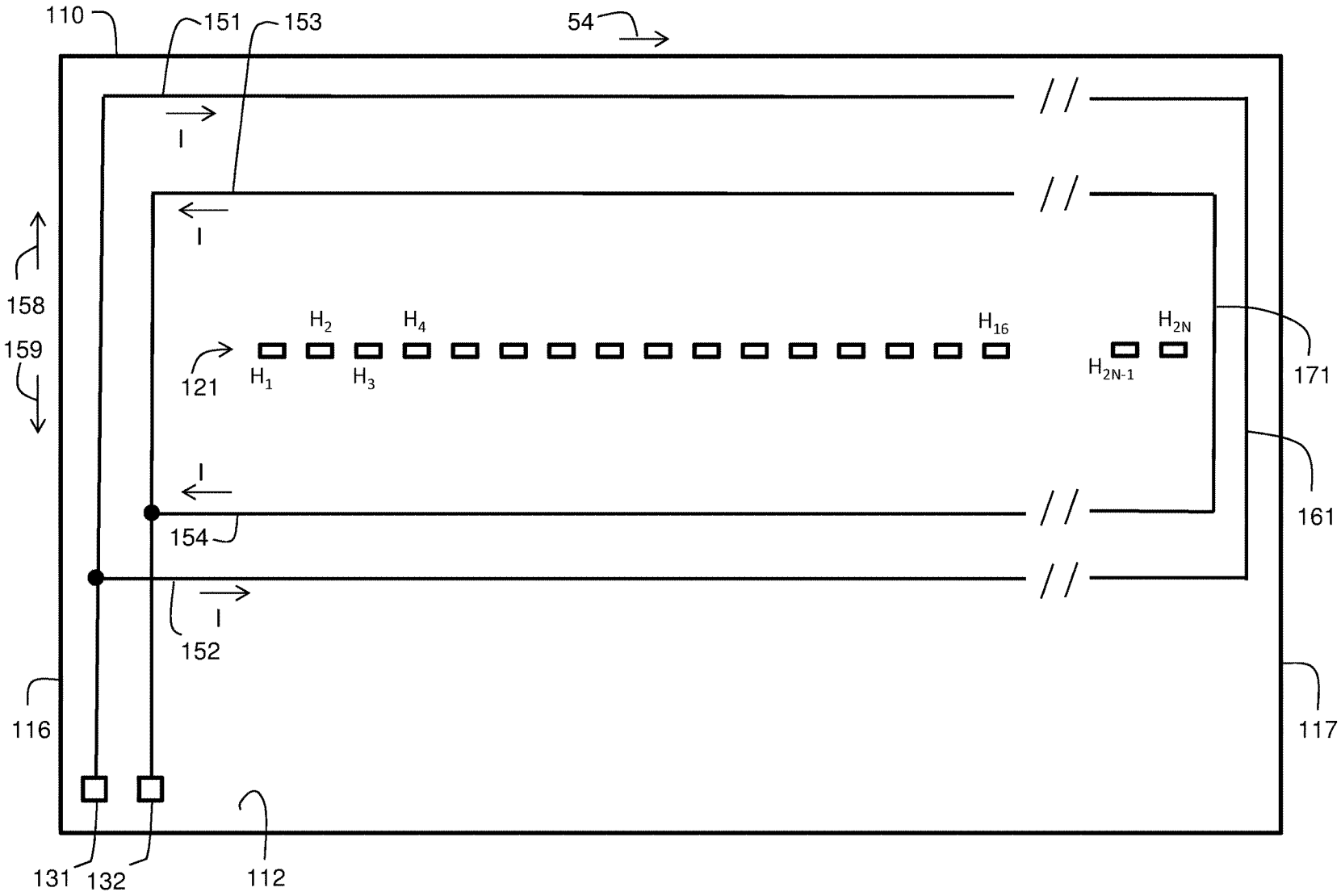
FIG. 7 shows a simplified representation of the drop ejector and bus line configuration shown in FIG. 5.

In order to compare various configurations of drop ejectors, power bus lines and current return lines in different embodiments, FIG. 7 is similar to FIG. 5 but with the driver transistors 146 and logic section 140 hidden. In FIG. 7, as described above with reference to FIG. 5, the first power bus line 151 is offset from the first drop ejector array (the odd numbered drop ejectors) in a first direction 158; the second power bus line 152 is offset from the second drop ejector array (the even numbered drop ejectors) in a second direction 159 opposite to the first direction 158; the first current return bus line 153 is offset from the first drop ejector array in the first direction 158 and is disposed between the first power bus line 151 and the first drop ejector array; and the second current return bus line 154 is offset from the second drop ejector array in the second direction 159 and is disposed between the second power bus line 152 and the second drop ejector array. In addition, the first plurality of drop ejectors, i.e. the odd-numbered drop ejectors, and the second plurality of drop ejectors, i.e. the even-numbered drop ejectors, are aligned with each other along the array direction 54.

Figure 8:
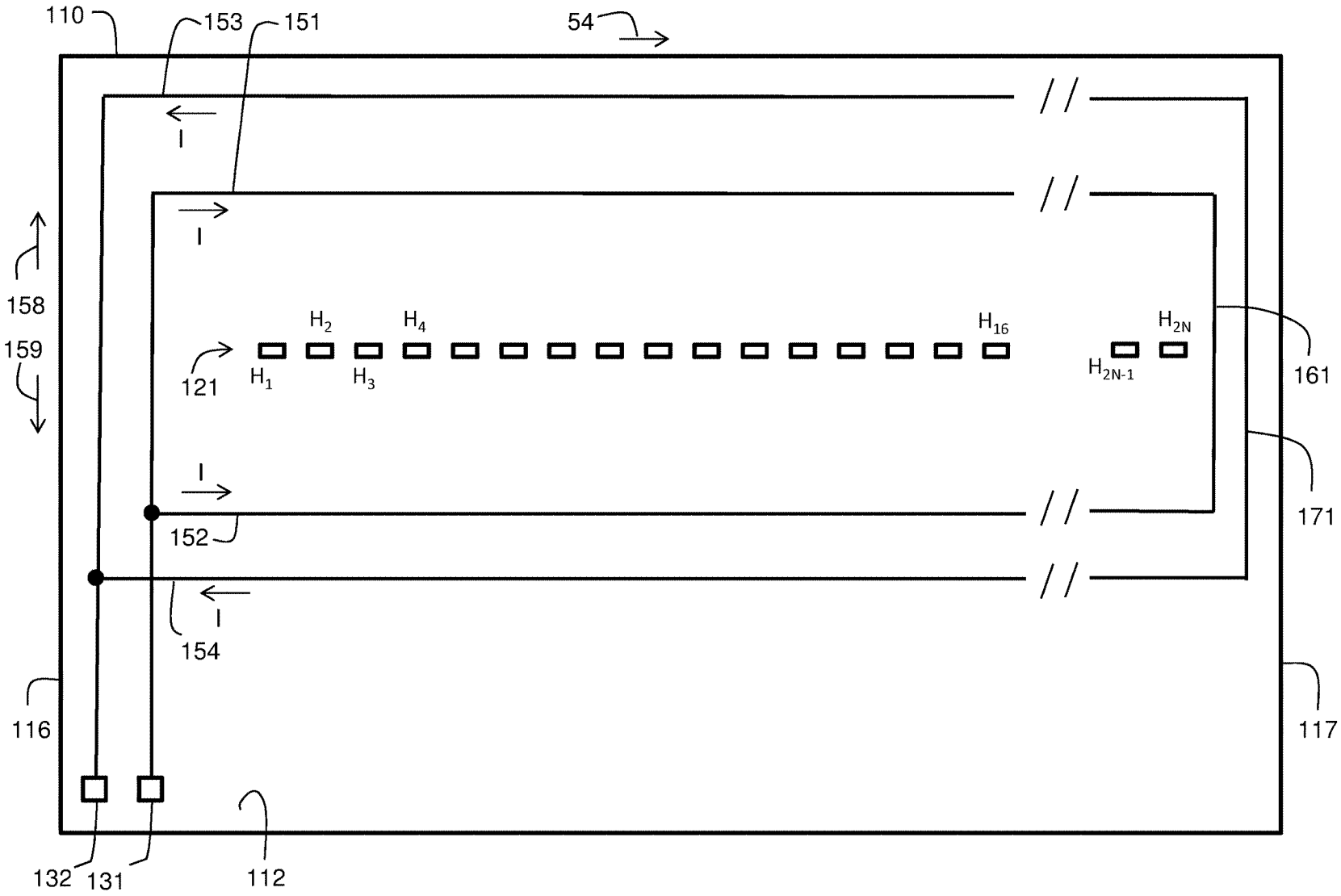
FIG. 8 shows another embodiment having a different configuration.

FIG. 8 shows an embodiment where the drop ejector configuration is similar to FIG. 7, but the voltage input terminal 131 and the current return terminal 132 have reversed positions. Similarly the first power bus line 151 and the first current return bus line 153 have reversed positions; the second power bus line 152 and the second current return bus line 154 have reversed positions; and the primary power bus connector line 161 and the primary current return bus connector line 171 have reversed positions.

FIG. 9 shows an embodiment having voltage input terminal 131, current return terminal 132, power bus lines 151 and 152, current return bus lines 153 and 154, and primary power bus connector line 161 and primary current return bus connector line 171 similar to FIG. 7. However, the first plurality of drop ejectors, i.e. the odd-numbered drop ejectors, and the second plurality of drop ejectors, i.e. the even-numbered drop ejectors, are not aligned with each other along the array direction 54, but rather are offset to provide a staggered configuration of the pair of drop ejector arrays 121.

Figure 10:
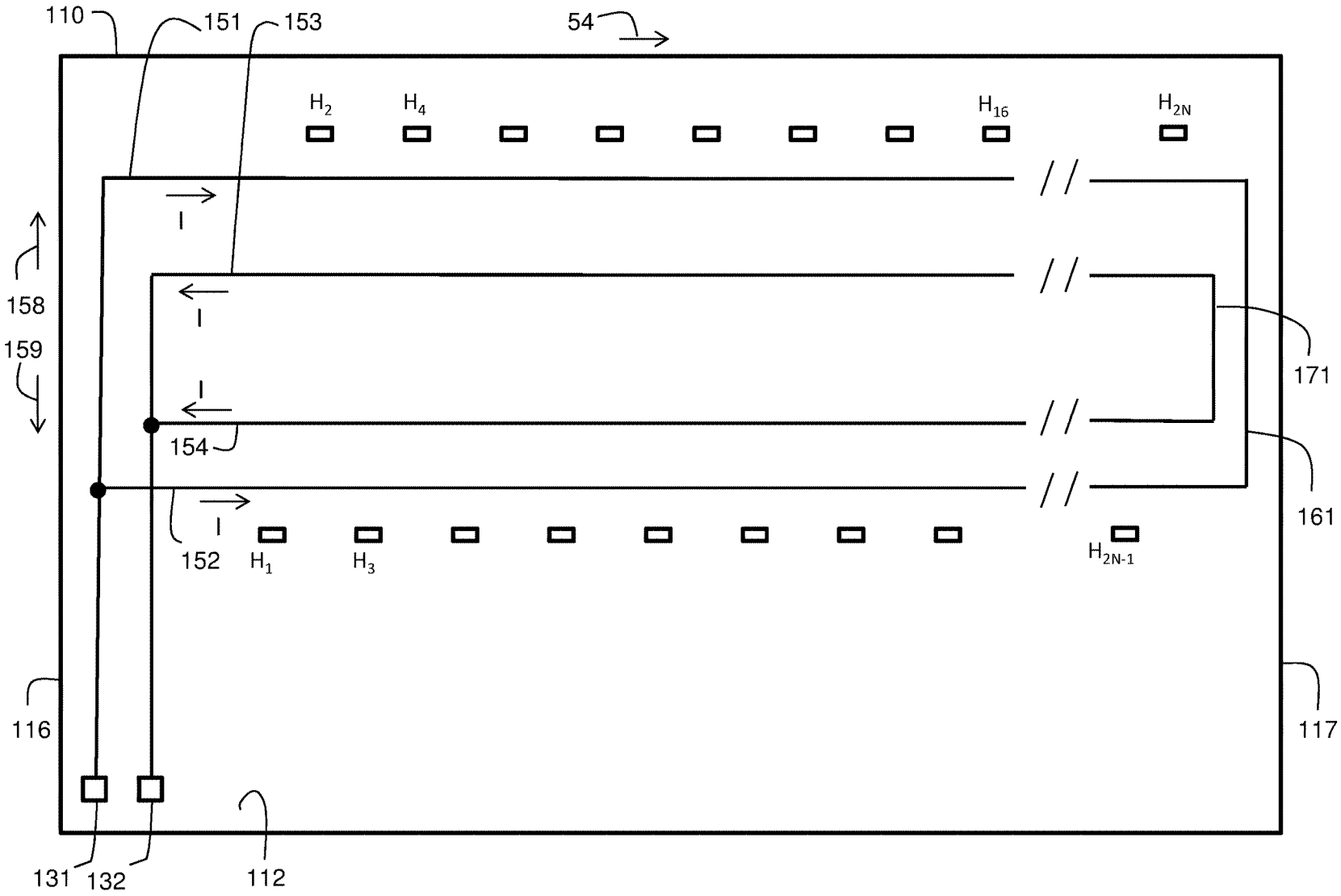
FIG. 10 shows another embodiment having a different configuration.

FIG. 10 shows an embodiment having a configuration similar to FIG. 9 but having a greater offset between the odd-numbered drop ejectors (the first drop ejector array) and the even-numbered drop ejectors (the second drop ejector array). In the embodiment shown in FIG. 10, the first and second power bus lines 151 and 152 and the first and second current return bus lines 153 and 154 are disposed between the first and second drop ejector arrays.

Figure 11:
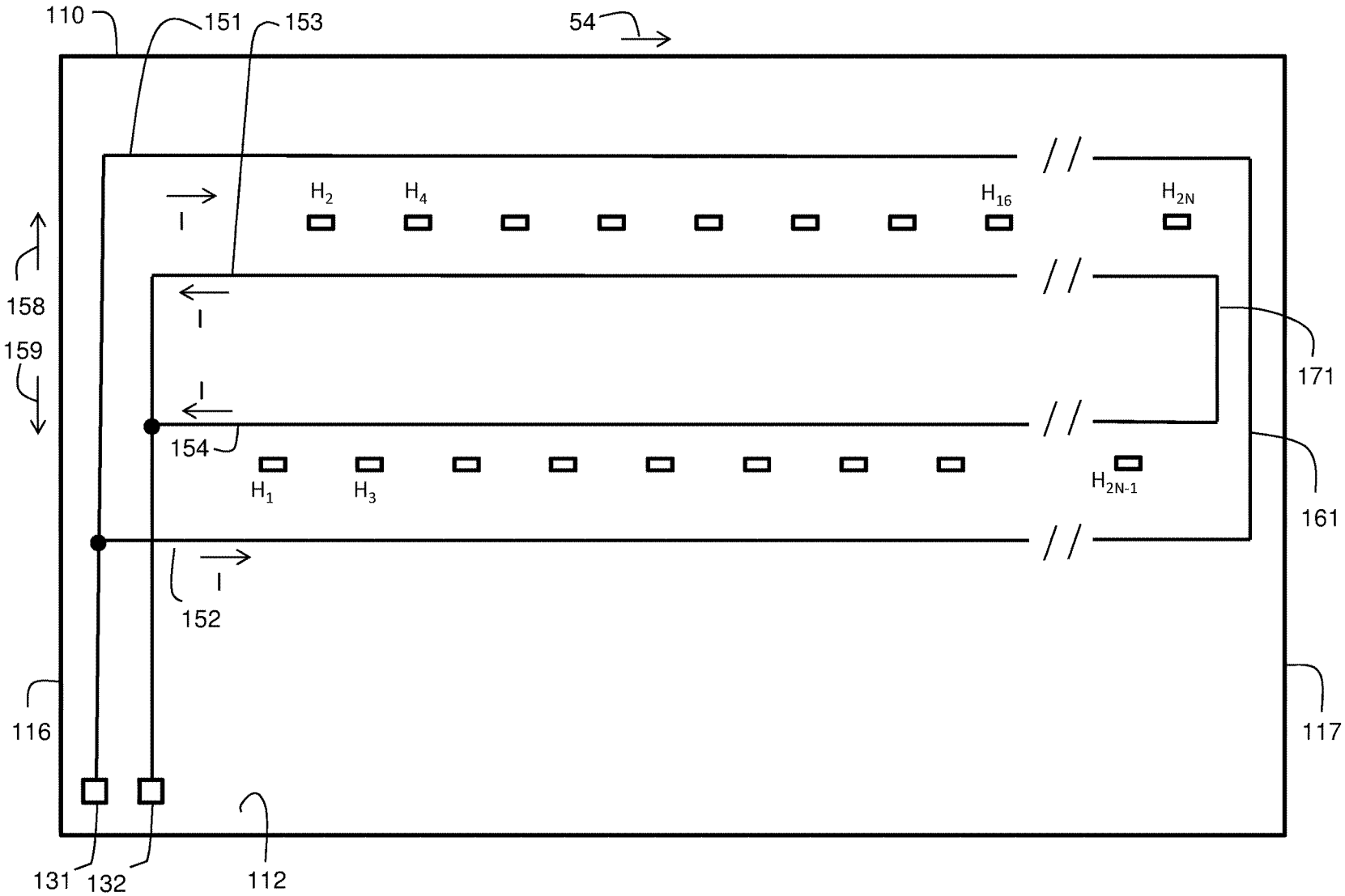
FIG. 11 shows another embodiment having a different configuration.

FIG. 11 shows another embodiment having offset drop ejectors, but with an offset that is intermediate between the examples shown in FIGS. 9 and 10. In the embodiment shown in FIG. 11, the first drop ejector array (the odd-numbered drop ejectors) is disposed between the first power bus line 151 and the first current return bus line 153. In addition, the second drop ejector array (the even-numbered drop ejectors) is disposed between the second power bus line 152 and the second current return bus line 154.

Figure 12:
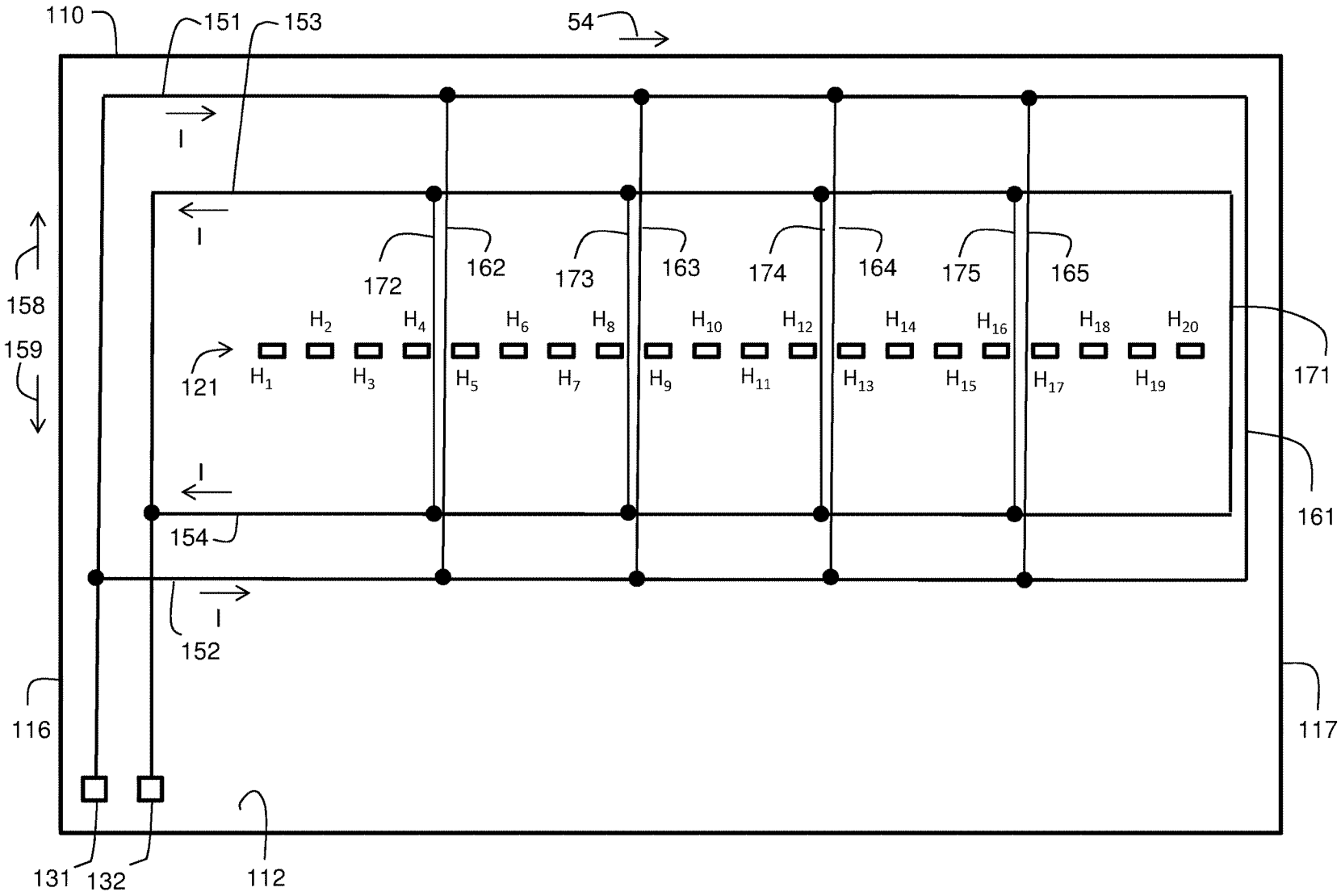
FIG. 12 shows an embodiment having auxiliary bus line connectors.

Further reductions in variation of parasitic voltage drop can be achieved by adding at least one auxiliary power bus connector line and at least one auxiliary current return bus connector line. FIG. 12 shows an example of a drop ejector configuration similar to FIG. 7 where there are twenty heating elements $H_1$ to $H_{20}$, and where four auxiliary power bus connector lines 162, 163, 164 and 165 and four auxiliary current return bus connector lines 172, 173, 174 and 175 are provided in addition to the primary power bus connector line 161 and the primary current return bus connector line 171. Each of the auxiliary power bus connector lines 162-165 are disposed between the primary power bus connector line 161 and the first side edge 116 of drop ejector array device 110. Similarly, each of the auxiliary current return bus connector lines 172-175 are disposed between the primary current return bus connector line 171 and the first side edge 116 of drop ejector array device 110.

For simplicity, in FIGS. 5, 7-12 and 14-15 the power bus lines 151 and 152, the current return bus lines 153 and 154, the primary power bus connector and primary current return bus connector lines 161 and 171, the auxiliary power bus connector lines 162-165 and the auxiliary current return connector lines 172-175 are all shown as simple straight lines. In many embodiments it is advantageous for one or more of these lines to be variable in width or shape in order to effectively utilize space around other circuit elements. To keep the resistance low, such lines can be made as wide as possible in regions where there is enough space, and narrower where necessary to avoid contact with other circuit elements. Herein the terms power bus lines, current return bus lines, primary power bus connector lines, primary current return bus connector lines, auxiliary power bus connector lines and auxiliary current return connector lines are all understood to include variable shapes and widths of lines.

In some embodiments it can be advantageous for one or more of the auxiliary power bus connector lines 162-165 to be replaced by lines that connect directly to additional voltage input terminals (not shown), separate from voltage input terminal 131, rather than connecting to second power bus line 152. Similarly, one or more of the auxiliary current return bus connector lines 172-175 can be replaced by lines that connect directly to additional current return input terminals (not shown), separate from current return terminal 132, rather than connecting to second current return bus line 154.

In the example shown in FIG. 12 the drop ejectors are arranged as five groups of drop ejectors $H_1$ to $H_4$, $H_5$ to $H_8$, $H_9$ to $H_{12}$, $H_{13}$ to $H_{16}$, and $H_{17}$ to $H_{20}$. During each print cycle, one member of each group can be selectively fired according to the image data. For example, during a first print cycle the set of drop ejectors $H_1$, $H_5$, $H_9$, $H_{13}$ and $H_{17}$ can be selectively fired. During a second print cycle the set of drop ejectors $H_2$, $H_6$, $H_{10}$, $H_{14}$ and $H_{18}$ can be selectively fired. During a third print cycle the set of drop ejectors $H_3$, $H_7$, $H_{11}$, $H_{15}$ and $H_{19}$ can be selectively fired. During a fourth print cycle the set of drop ejectors $H_4$, $H_8$, $H_{12}$, $H_{16}$ and $H_{20}$ can be selectively fired to complete the printing stroke. In the embodiment of FIG. 12, the auxiliary power bus connector lines 162-165 and the auxiliary current return bus connector lines 172-175 are disposed at the boundaries between groups. Such a placement of the auxiliary power bus connector lines and auxiliary current return bus connector lines is effective in reducing the abrupt change in parasitic voltage drops at the borders between groups as described and shown above with reference to FIGS. 3 to 6.

Figure 13:
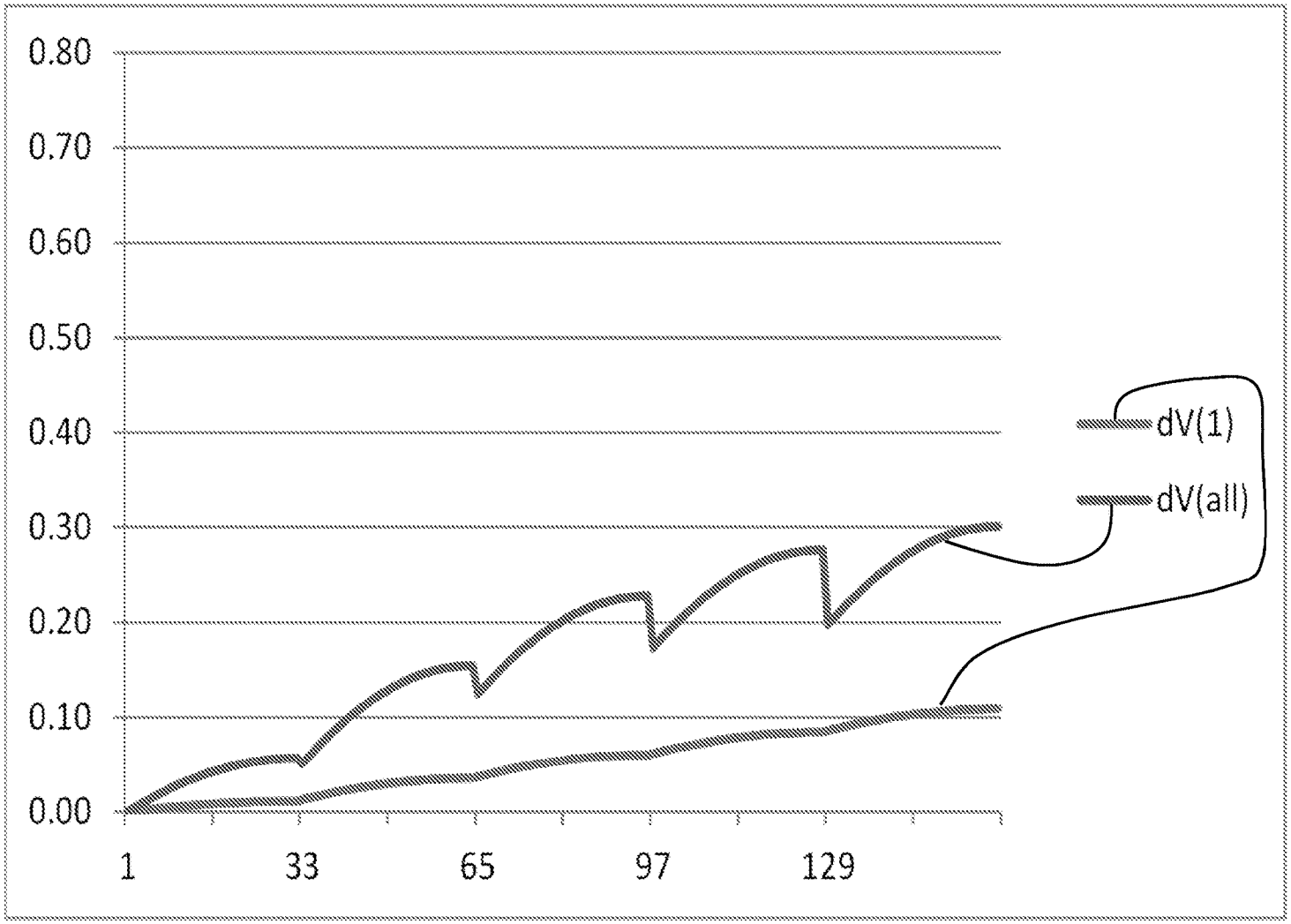
FIG. 13 shows the resulting variation in parasitic voltage drop for a drop ejector array device similar to that shown in FIG. 12.

FIG. 13 shows the resulting variation in parasitic voltage drop for a drop ejector array device shown in FIG. 5 where 2N=160 and the drop ejectors are fired in 32 print cycles with up to five drop ejectors fired per print cycle, but with the addition of auxiliary power bus connector lines and auxiliary current return bus connector lines disposed at the borders between groups of drop ejectors as shown in FIG. 12. In other words, pairs of auxiliary power bus connector lines and auxiliary current return bus connector lines are positioned between $H_{32}$ and $H_{33}$, between $H_{64}$ and $H_{65}$, between $H_{96}$ and $H_{97}$, and between $H_{128}$ and $H_{129}$. Since the groups each have 32 members (16 odd-numbered drop ejectors of the first drop ejector array and 16 even-numbered drop ejectors of the second drop ejector array), the auxiliary power bus connector lines and the auxiliary current return bus connector lines are disposed at positions along the array direction 54 that divide the first drop ejector array and the second drop ejector array into groups of equal numbers of drop ejectors (groups of 32 in this example). By comparing FIG. 13 to FIG. 6 it can be seen that the addition of the auxiliary power bus connector lines and the auxiliary current return bus connector lines results in a lower maximum variation in parasitic voltage drop (0.30 voltage units compared to 0.38 voltage units) for dV(all), and also decreases the amount of abrupt change in parasitic voltage drops at the borders between groups.

Figure 14:
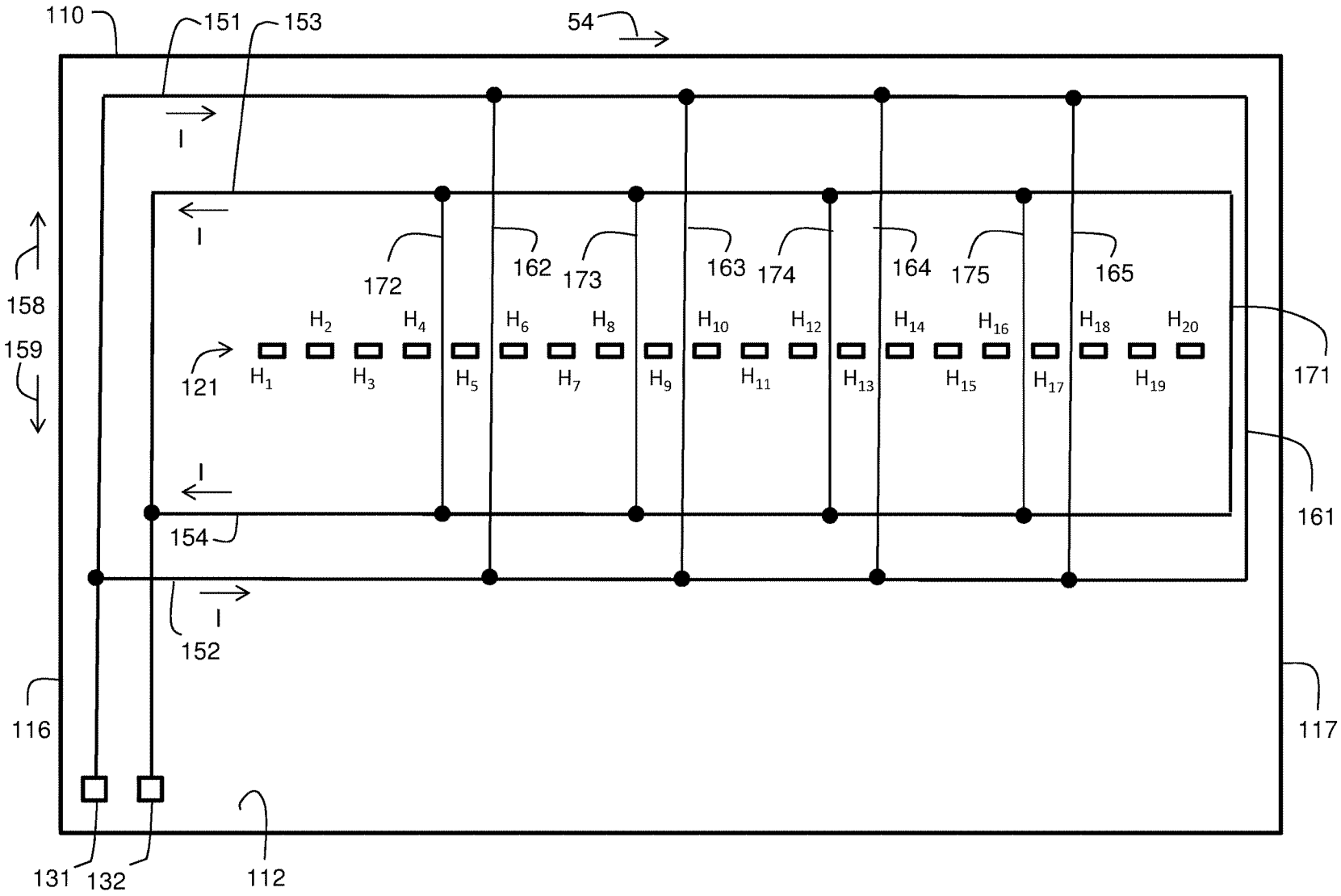
FIG. 14 shows another embodiment having auxiliary bus line connectors.

The addition of auxiliary power bus connector lines and auxiliary current return bus connector lines is advantageous in reducing the variation in parasitic voltage drop even if they are not disposed precisely at the borders between groups of drop ejectors. For example, FIG. 14 shows an embodiment where the auxiliary current return bus connector lines 172-175 are disposed at the boundaries between groups (i.e. between $H_4$ and $H_5$, between $H_8$ and $H_9$, between $H_{12}$ and $H_{13}$, and between $H_{16}$ and $H_{17}$). However, the auxiliary power bus connector lines 162-165 are disposed near to but not at the boundaries between groups (i.e. between $H_5$ and $H_6$, between $H_9$ and $H_{10}$, between $H_{13}$ and $H_{14}$, and between $H_{17}$ and $H_{18}$). Such a configuration gives more room for the auxiliary power bus connector lines 162-165 and the auxiliary current return bus connector lines 172-175 to pass between neighboring drop ejectors. The auxiliary current return bus connector lines 172-175 are disposed at positions along the array direction 54 that divide the first drop ejector array and the second drop ejector array into five clusters each having four drop ejectors $H_1$ to $H_4$, $H_5$ to $H_8$, $H_9$ to $H_{12}$, $H_{13}$ to $H_{16}$, and $H_{17}$ to $H_{20}$. The auxiliary power bus connector lines 162-165 are disposed at positions along the array direction 54 that divide the first drop ejector array and the second drop ejector array into three clusters having four drop ejectors $H_6$ to $H_9$, $H_{10}$ to $H_{13}$, and $H_{14}$ to $H_{17}$, plus a cluster having five drop ejectors $H_1$ to $H_5$, and a cluster having three drop ejectors $H_{18}$ to $H_{20}$. In general it is advantageous for the at least one auxiliary power bus connector line and the at least one auxiliary current return bus connector line to be disposed at positions along the array direction 54 that divide the first drop ejector array and the second drop ejector array into at least two clusters of substantially equal numbers of drop ejectors, where substantially equal is understood to be within 10%. In the example of FIG. 14, three of the five clusters corresponding to the placement of the auxiliary power bus connector lines 162-165 have an equal number of four drop ejectors. The other two clusters have three drop ejectors and five drop ejectors, neither of which is within 10% of the number of drop ejectors in any of the other clusters. However, at least two of the five clusters have equal numbers, thereby satisfying being substantially equal. Similarly, a drop ejector array device 110 having 160 drop ejectors as in FIG. 5 with auxiliary power bus lines positioned between $H_{30}$ and $H_{31}$, between $H_{64}$ and $H_{65}$, between $H_{97}$ and $H_{98}$, and between $H_{129}$ and $H_{130}$ has a first cluster of 30 drop ejectors, a second cluster of 34 drop ejectors, a third cluster of 33 drop ejectors, a fourth cluster of 32 drop ejectors and a fifth cluster of 31 drop ejectors. The only clusters in this example that do not have substantially equal numbers of drop ejectors relative to each other are the first cluster and the second cluster.

Figure 15:
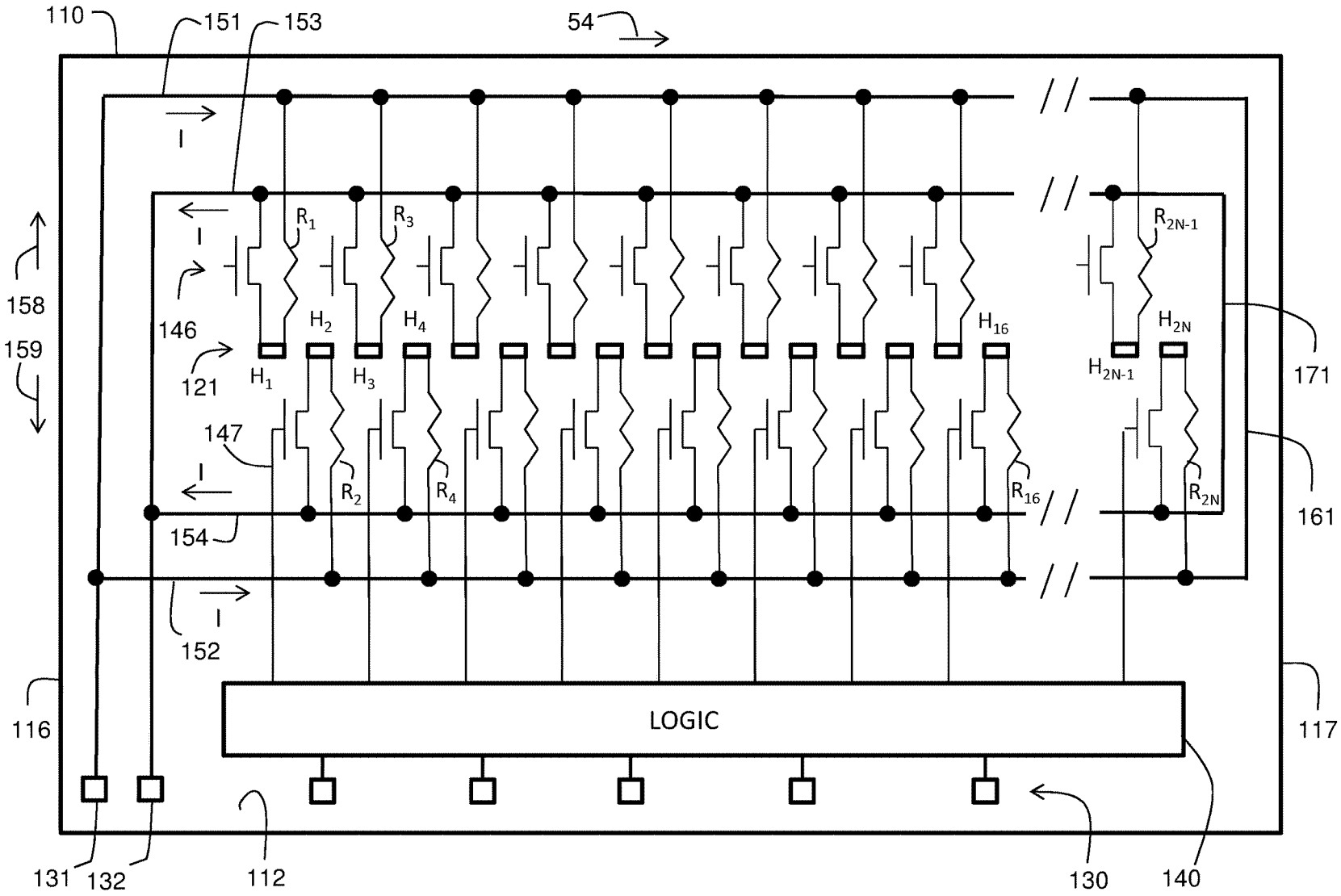
FIG. 15 shows an embodiment having compensation resistors having a predetermined resistance in series with each drop ejector.

Further reductions in variation of parasitic voltage drops can be achieved by connecting a corresponding compensation resistor having a predetermined resistance in series with each drop ejector, where the predetermined resistances of the corresponding compensation resistors are chosen to reduce parasitic voltage drop variations during operation. FIG. 15 shows an embodiment similar to that shown in FIG. 5, but with the addition of compensation resistors $R_1$ to $R_{2N}$ connected in series with the corresponding drop ejectors $H_1$ to $H_{2N}$.

Figure 16:
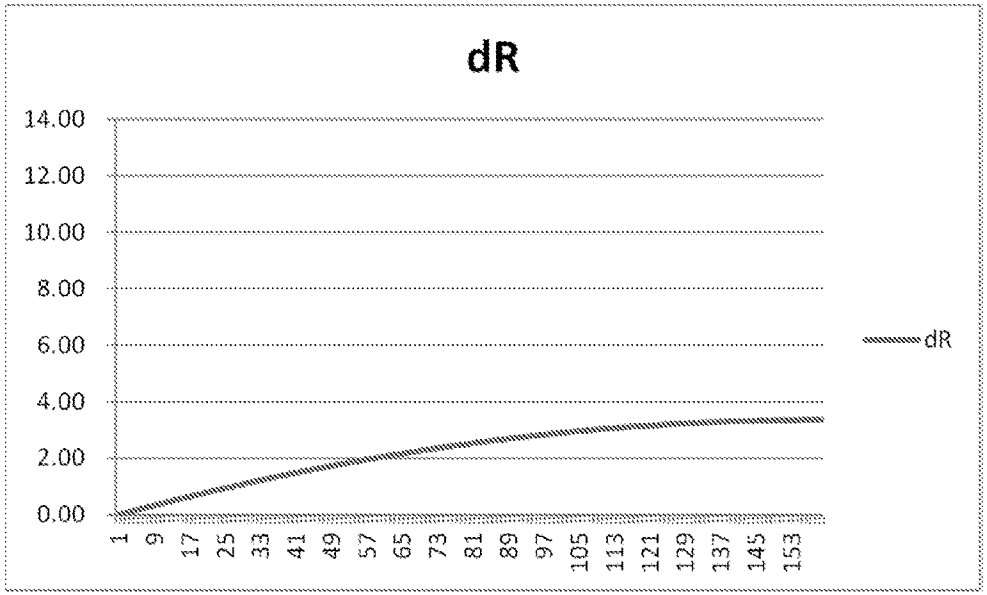
FIG. 16 shows an example of a change of compensation resistances dR to compensate for parasitic voltage drop when a single drop ejector is fired in each print cycle.

The values of the predetermined resistances can be chosen in various ways to compensate for parasitic voltage drop variations. FIG. 16 shows an example of the magnitude of the change of compensation resistances dR relative to the predetermined resistances of compensation resistor $R_1$ corresponding to actuator $H_1$ for the drop ejector configuration where the number of drop ejectors 2N=160 and the drop ejectors are fired in 32 print cycles with up to five drop ejectors fired per print cycle, as in the previous examples described above. In FIG. 16 and in the other subsequent figures showing changes in compensation resistances dR, the largest compensation resistor is $R_1$ corresponding to the drop ejector $H_1$ that is closest to the voltage input terminal 131 and the current return terminal 132. In the example shown in FIG. 16, the value of the predetermined resistances of compensation resistors $R_1$ to $R_N$ corresponding to drop ejectors $H_1$ to $H_N$ for firing one drop ejector at a time gradually decreases from the first drop ejector $H_1$ to the last drop ejector $H_N$ in a monotonic fashion.

Figure 17:
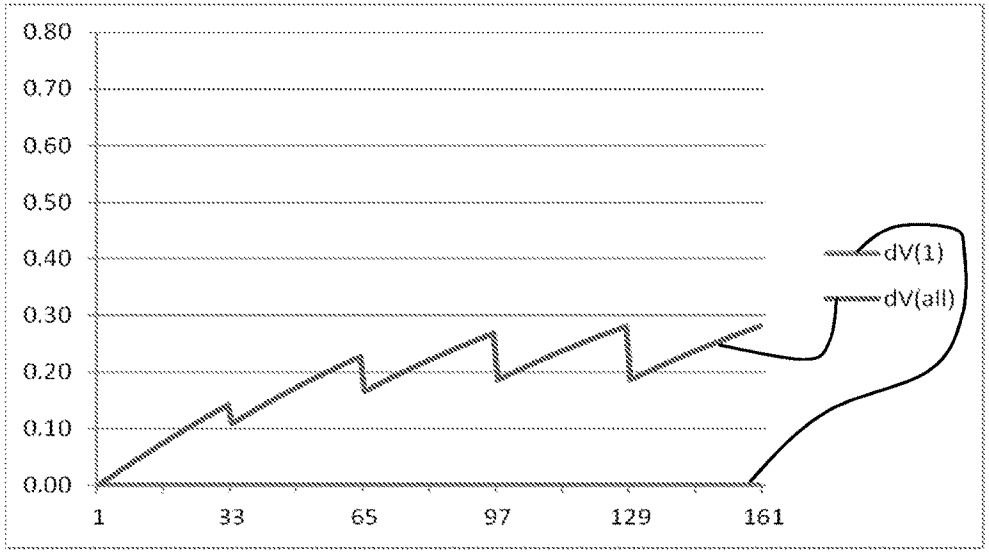
FIG. 17 shows the resulting variation in parasitic voltage drop for a drop ejector array device similar to that of FIG. 15 with the compensation resistances of FIG. 16.

FIG. 17 shows the resulting variation in parasitic voltage drop for a drop ejector array device corresponding to the selection of predetermined resistances of FIG. 16, where no auxiliary power bus connector lines or current return bus connector lines are provided. As can be seen in curve dV(1)

of FIG. 17, the compensation resistors $R_1$ to $R_N$ of FIG. 16 provides perfect compensation for parasitic voltage drop variation for the case of firing one drop ejector at a time. Comparing curve dV(all) of FIG. 17 with curve dV(all) of FIG. 6 shows that parasitic voltage drop variation for the case of firing all five drop ejectors at a time in each set in each print cycle provides a reduction in the maximum variation in parasitic voltage drop between the first drop ejector $H_1$ and the last drop ejector $H_{160}$ from 0.38 voltage units to 0.28 voltage units.

Figure 18:
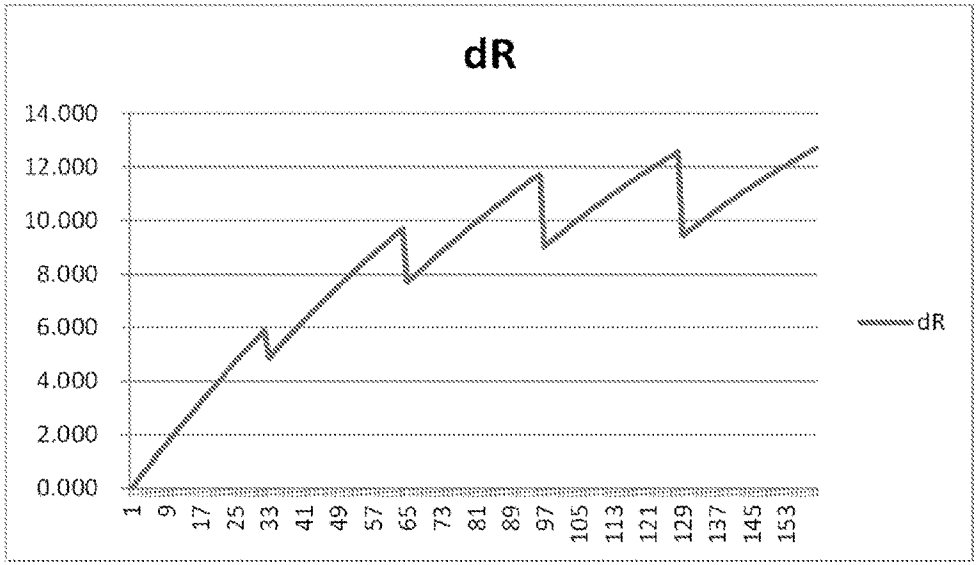
FIG. 18 shows an example of a change of compensation resistances dR to compensate for parasitic voltage drop when entire sets of drop ejectors are fired in each print cycle.

FIG. 18 shows an example of the magnitude of the change of compensation resistances dR relative to the predetermined resistance of compensation resistor $R_1$ corresponding to actuator $H_1$ for the drop ejector configuration where the number of drop ejectors 2N=160 and the drop ejectors are fired in 32 print cycles, as in the previous examples described above. For the example shown in FIG. 18, the value of the predetermined resistances of compensation resistors $R_1$ to $R_N$ corresponding to drop ejectors $H_1$ to $H_N$ for firing all five drop ejectors at a time in each print cycle decreases from the first drop ejector $H_1$ to the last drop ejector $H_N$ but not in a monotonic fashion. Rather, the compensation resistance decreases at the borders between groups of drop ejectors, such that $R_{33}$ is greater than $R_{32}$, for example.

Figure 19:
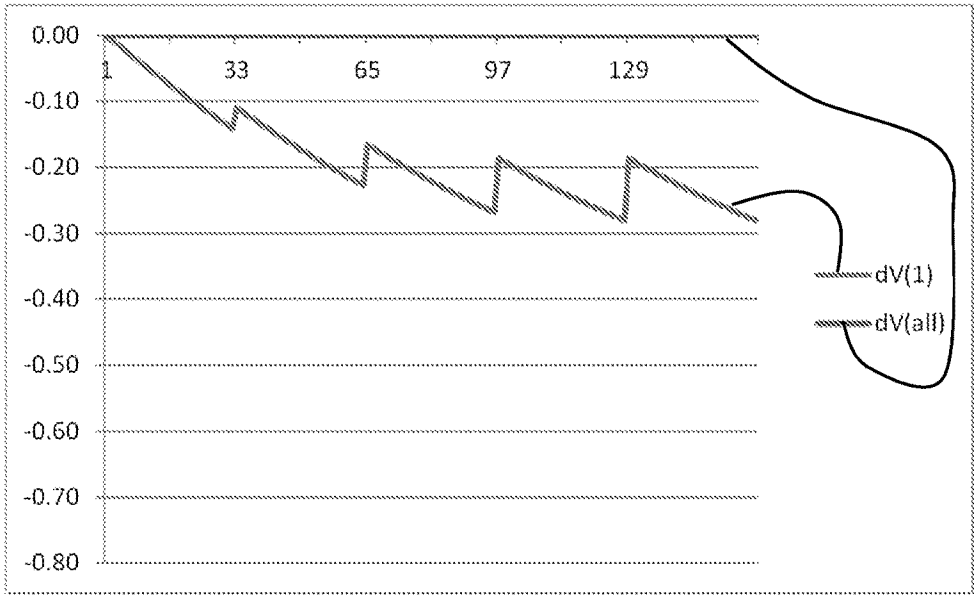
FIG. 19 shows the resulting variation in parasitic voltage drop for a drop ejector array device similar to that of FIG. 15 with the compensation resistances of FIG. 18.

FIG. 19 shows the resulting variation in parasitic voltage drop for a drop ejector array device corresponding to the selection of predetermined resistances of FIG. 18, where no auxiliary power bus connector lines or current return bus connector lines are provided. As can be seen in curve dV(all) of FIG. 19, the compensation resistors $R_1$ to $R_N$ of FIG. 18 provides perfect compensation for parasitic voltage drop variation for the case of firing all five drop ejectors at a time. Comparing curve dV(1) of FIG. 19 with curve dV(1) of FIG. 6 shows that parasitic voltage drop variation for the case of firing one drop ejector at a time in each set in each print cycle results in an increase in the magnitude of the maximum variation in parasitic voltage drop between the first drop ejector $H_1$ and the last drop ejector $H_{160}$ for firing one drop ejector at a time from 0.10 voltage units to 0.28 voltage units.

As shown in FIG. 15, in the examples of FIGS. 16 and 18, first drop ejector $H_1$ is closest to the voltage input terminal 131 and the last drop ejector $H_{160}$ is farthest from the voltage input terminal 131. As seen in the examples of FIGS. 16 and 18, the value of the predetermined resistance for the compensation resistor $R_1$ in series with the first drop ejector $H_1$ is larger than the value of the predetermined resistance for the compensation resistor $R_{160}$ in series with the last drop ejector $H_{160}$.

Further reductions in the variation of parasitic voltage drop can be achieved by providing auxiliary power bus connector lines and auxiliary current return connector lines as described above with reference to FIGS. 12 to 14 in addition to compensation resistors having predetermined resistances as described above with reference to FIGS. 15 to 19.

Figure 20:
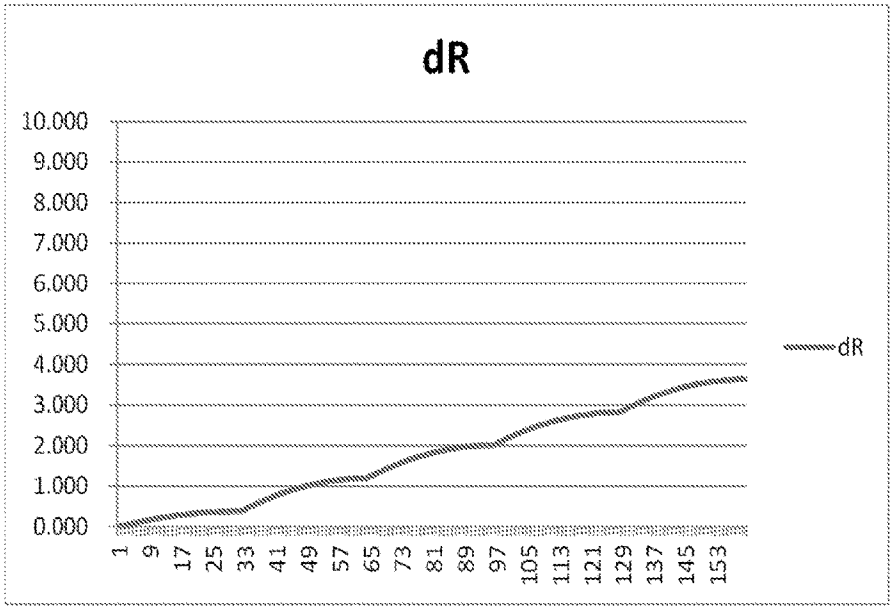
FIG. 20 shows values of predetermined resistances of compensation resistors for a configuration and firing similar to FIG. 16 but with the addition of auxiliary power bus connector lines and auxiliary current return connector lines.

FIG. 20 shows the magnitude of the change of resistances of compensation resistors for a configuration similar to FIG. 16 but with the addition of auxiliary power bus connector lines and auxiliary current return connector lines. As shown by curve dV(1) in FIG. 21, variation of parasitic voltage drop has been perfectly compensated for firing one drop ejector at a time, similar to curve dV(1) in FIG. 17. The further improvement in this example is for curve dV(all). For the example of FIGS. 20 and 21, the maximum parasitic voltage drop variation is 0.20 voltage units for firing all five drop ejectors at a time in each print cycle, which is less than the 0.28 voltage units for the examples of FIGS. 16 and 17.

Figure 22:
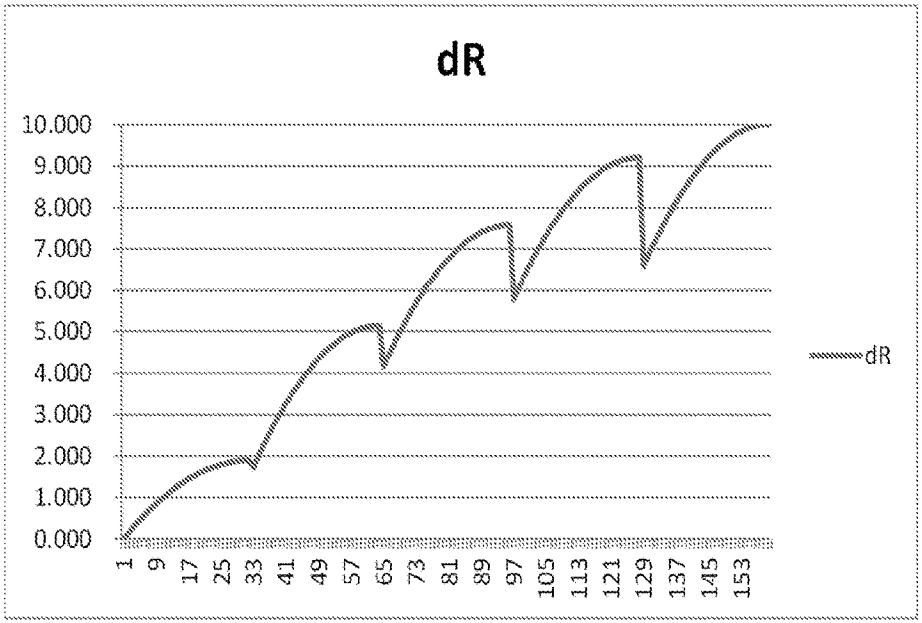
FIG. 22 shows values of predetermined resistances of compensation resistors for a configuration and firing similar to FIG. 18 but with the addition of auxiliary power bus connector lines and auxiliary current return connector lines.

FIG. 22 shows the magnitude of the change of resistances of compensation resistors for a configuration similar to FIG. 18 but with the addition of auxiliary power bus connector lines and auxiliary current return connector lines. As shown by curve dV(all) in FIG. 23, variation of parasitic voltage drop has been perfectly compensated for the case of firing all five drop ejectors each print cycle, similar to curve dV(all) in FIG. 19. Comparing curve dV(1) in FIG. 23 with the curve dV(1) in FIG. 19 it can be seen that the magnitude of the maximum variation in parasitic voltage drop has been reduced from 0.28 voltage units to 0.20 voltage units.

Figure 21:
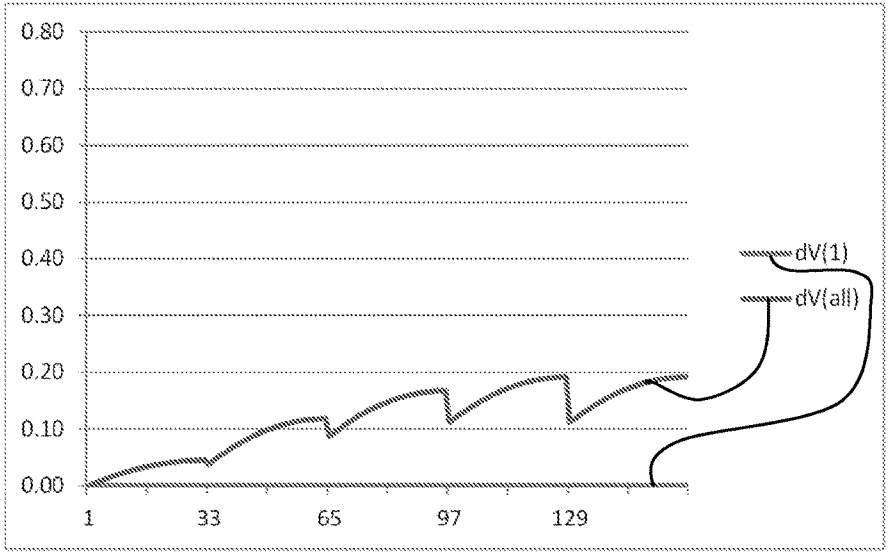
FIG. 21 shows the resulting variation in parasitic voltage drop with the compensation resistances of FIG. 20.
Figure 23:
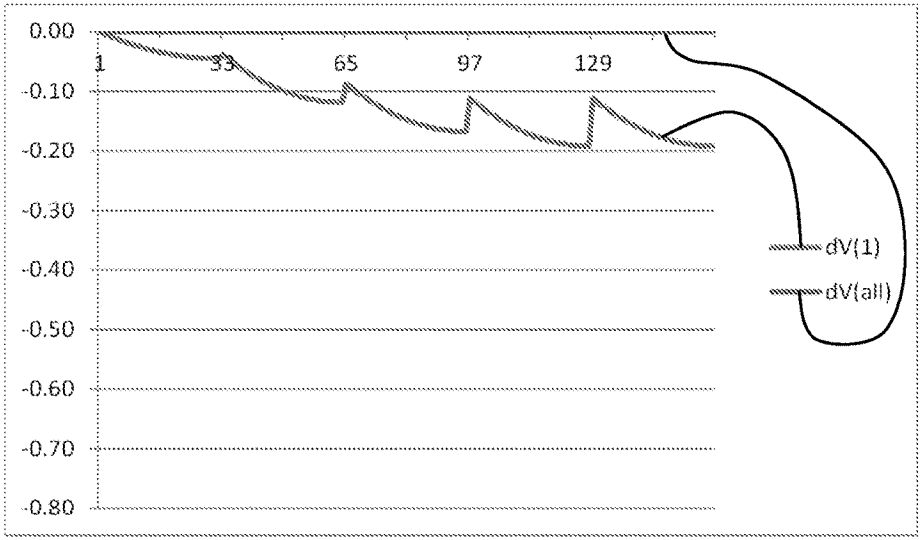
FIG. 23 shows the resulting variation in parasitic voltage drop with the compensation resistances of FIG. 22.
Figure 24:
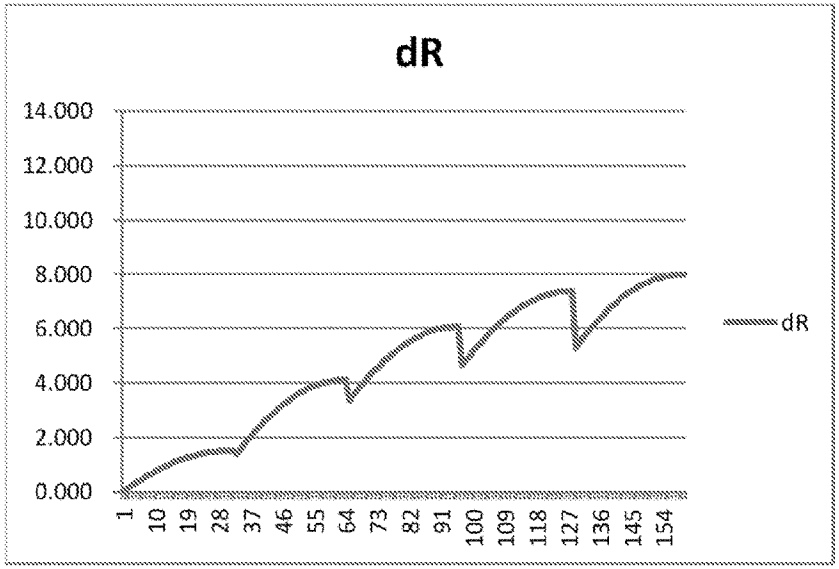
FIG. 24 shows values of predetermined resistances of compensation resistors that are intermediate between those shown in FIGS. 20 and 22.
Figure 25:
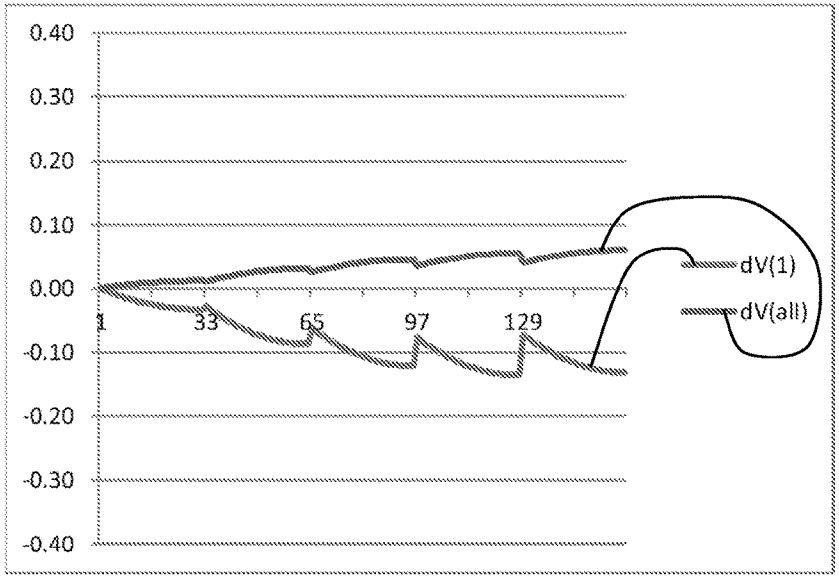
FIG. 25 shows the resulting variation in parasitic voltage drop with the compensation resistances of FIG. 24.

As can be seen in FIGS. 24 and 25, the values of the predetermined resistances of the compensation resistors can alternatively be chosen intermediate between perfect compensation for firing one drop ejector at a time as in the dR and dV(1) curves in FIGS. 20 and 21 and perfect compensation for firing all five drop ejectors at a time for each print cycle as in the dR and dV(all) curves in FIGS. 22 and 23.

In the method of operating the inkjet printhead, the driving voltage applied to voltage input terminal 131 can be determined based on a threshold ejection voltage corresponding to firing only the drop ejector $H_1$ that is closest to the voltage input terminal 131. For the example shown in FIG. 25, drop ejector $H_{160}$ would be overdriven when fired by itself by 0.14 voltage units, and it would be underdriven by 0.06 voltage units when fired together with the rest of the drop ejectors in its set. In some cases, 0.06 voltage units below the threshold voltage for $H_1$ is acceptable for firing $H_{160}$. In other examples, the driving voltage applied to voltage input terminal 131 can be determined based on a threshold ejection voltage corresponding to firing the entire set of drop ejectors that are farthest from the voltage input terminal 131, e.g. $R_{32}$, $R_{64}$, $R_{96}$, $R_{128}$ and $R_{160}$. In this case, the maximum overvoltage when firing one at a time would be 0.20 voltage units for drop ejector $H_{160}$. Drop ejector $H_1$ would be overdriven by 0.06 voltage units when fired either by itself or with the other members of its set.

Figure 26B:
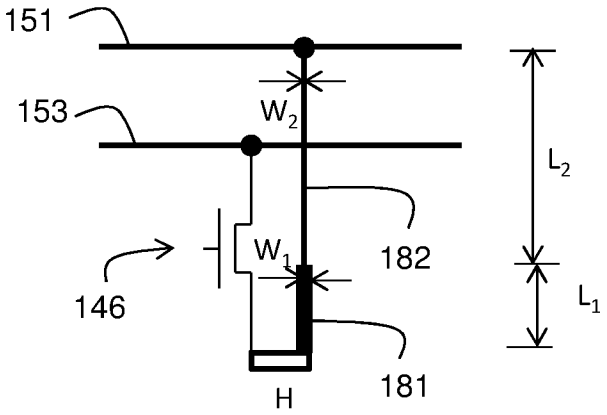
FIGS. 26A and 26B show examples of providing variation of the compensation resistors by varying the lengths and widths of electrically resistive lines.
Figure 26A:
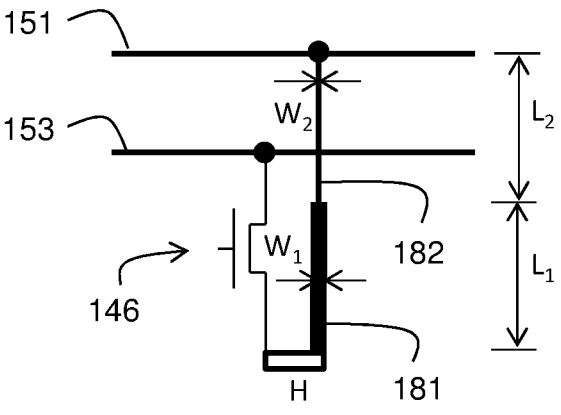

Compensation resistors should be formed separately from the heating elements themselves, as the size of the heating element influences the drop ejection performance such as drop volume and drop velocity. FIGS. 26A and 26B show examples of different compensation resistances provided by varying the lengths and widths of lines 181 and 182 that are disposed between the heating element H and the first power bus line 151. Typically such lines are formed by thin film aluminum or aluminum-copper. Although bulk aluminum is highly conductive, typical thicknesses of deposited thin film aluminum (about 1.25 microns) have a sheet resistance of 0.032 ohms per square so it is somewhat electrically resistive (see U.S. Pat. No. 4,887,098). By varying the lengths $L_1$ and $L_2$ and the widths $W_1$ and $W_2$ of lines 181 and 182 the required variation of the compensation resistors can be provided. (Note: in practice there would typically be a tapering of line widths between $W_1$ and $W_2$ in order to avoid sharp corners and hot spots.) Alternatively other electrically resistive materials can be used for lines 181 and 182 to provide the variation of the compensation resistors.

Figure 27:
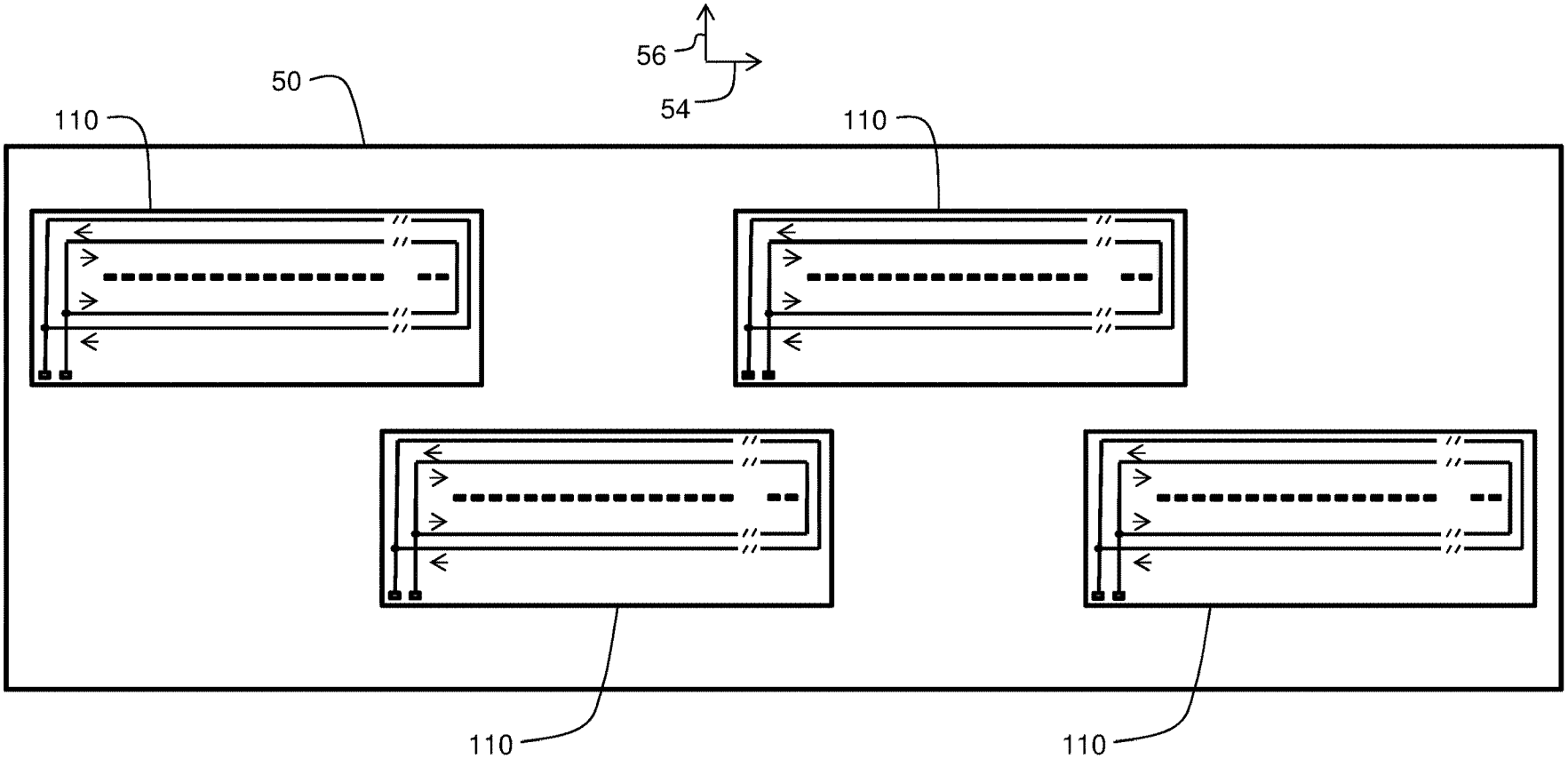
FIG. 27 shows an inkjet printhead having a staggered array of drop ejector array devices of the type shown in FIG. 7.

An inkjet printhead 50 can include a plurality of drop ejector array devices 110 described above in the various embodiments. For example, FIG. 27 shows an inkjet printhead 50 having a staggered array of drop ejector devices 110 of the type described above with reference to FIG. 7 in order to provide a wider print area in a single pass than can be achieved using a single drop ejector array device 110.

In the embodiments described above, the drop ejector array devices 110 include a single pair 121 of alternatingly disposed drop ejector arrays (i.e. a first drop ejector array and a second drop ejector array) where the first drop ejector array is connected to a corresponding first power bus line 151 and a corresponding current return bus line 153; where the second drop ejector array is connected to a corresponding second power bus line 152 and a corresponding second current return bus line 154; and where the corresponding first and second power bus lines 151 and 152 and the corresponding first and second current return bus lines 153 and 154 are connected by at least a corresponding primary power bus connector line 161 and a corresponding primary current return bus connector line 171 respectively. In other embodiments it can be advantageous for a drop ejector array device to include additional such pairs of alternatingly disposed drop ejector arrays for ejecting different colored inks or different sized drops, for example.

Figure 28:
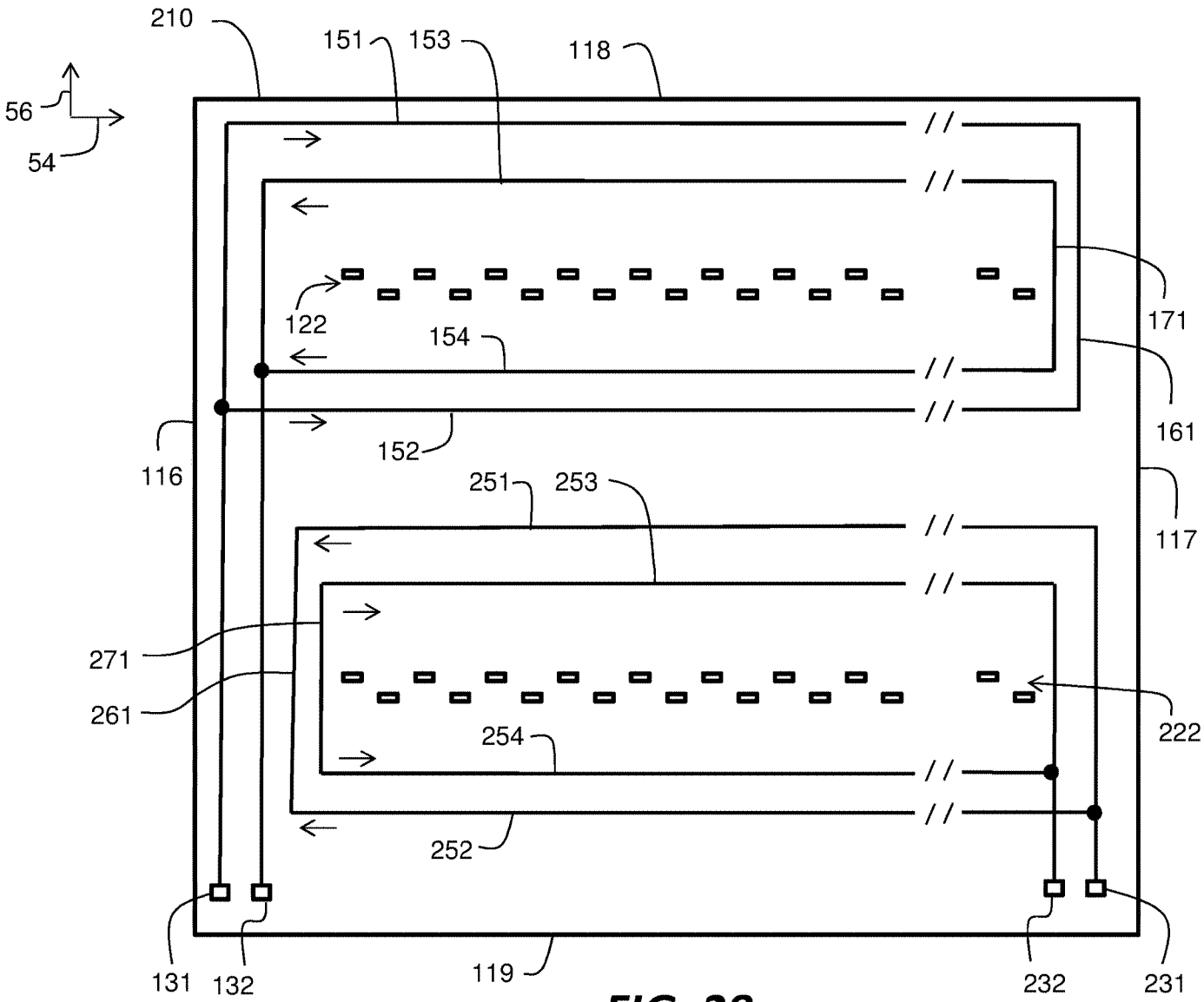
FIG. 28 shows a top view of a drop ejector array device having two pairs of alternatingly disposed drop ejector arrays that are connected to corresponding power bus lines and current return bus lines according to an embodiment of the invention.

FIG. 28 shows an embodiment of a drop ejector array device 210 including a first pair of drop ejector arrays 122 plus first corresponding first and second power bus lines 151 and 152, first corresponding first and second current return bus lines 153 and 154, first corresponding primary power bus connector line 161, first corresponding primary current return bus connector line 171, voltage input terminal 131 and first corresponding current return terminal 132 similar to that described above with reference to FIG. 9. Primary power bus connector line 161 and primary current return bus connector line 171 are proximate to second side edge 117, while voltage input terminal 131 and current return terminal 132 are proximate to the first side edge 116. Drop ejector array device 210 also includes a second pair of drop ejector arrays 222 plus second corresponding third and fourth power bus lines 251 and 252, second corresponding third and fourth current return bus lines 253 and 254, second primary power bus connector line 261, second primary current return bus connector line 271, second voltage input terminal 231 and second current return terminal 232. Second primary power bus connector line 261 and second primary current return bus connector line 271 are proximate to first side edge 116, while second voltage input terminal 231 and second current return terminal 232 are proximate to the second side edge 117.

Figure 29:
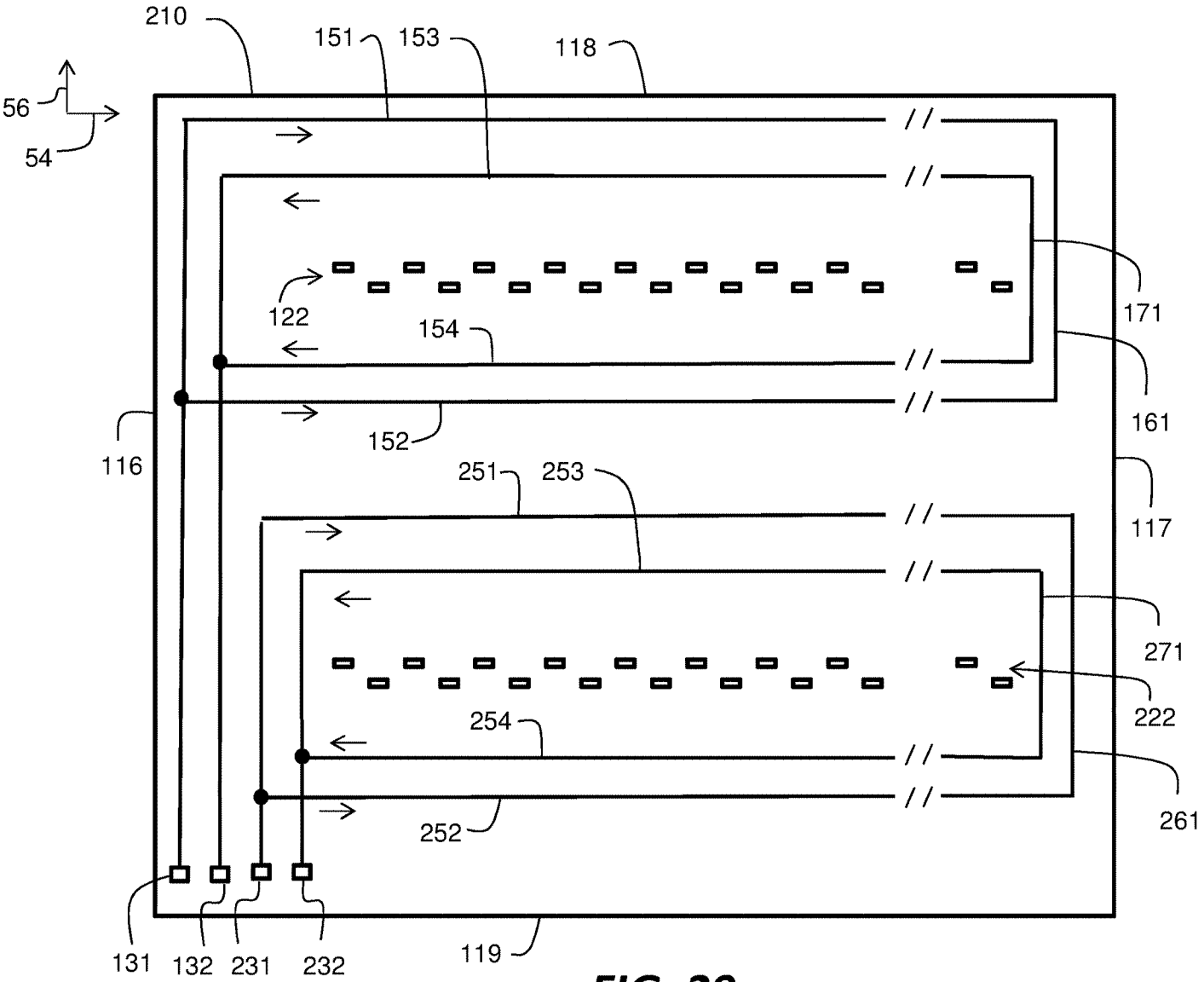
FIG. 29 shows a top view of a drop ejector array device having two pairs of alternatingly disposed drop ejector arrays that are connected to corresponding power bus lines and current return bus lines according to another embodiment of the invention.

FIG. 29 shows another embodiment in which the voltage input terminals 131 and 231 as well as the current return terminals 132 and 232 are located proximate to the first side edge 116 of the drop ejector array device, and the primary power bus connector lines 161 and 261 as well as the current return bus connector lines 171 and 271 are located proximate to the second side edge 117 of the drop ejector array device.

In the examples shown in FIGS. 28 and 29, the voltage input terminals 131 and 231 as well as the current return terminals 132 and 232 are located proximate to the bottom edge 119 of drop ejector array device 210. In other embodiments (not shown) drop ejector array devices can include additional pairs of drop ejector arrays and corresponding power bus, current return bus, and bus connector lines where the associated voltage input terminals and current return terminals are located proximate to the top edge 118 (FIGS. 28 and 29) of the drop ejector array device. In this way a drop ejector array device according to embodiments of the invention can be used to eject more than two types of ink (for example, cyan, magenta, yellow and black ink), or more than two different ink drop sizes.

In the embodiments described above the actuator of the drop ejector has been a heating element. However, it is understood that variations in parasitic voltage drop can affect the drop ejection performance of other types of actuators, such as piezoelectric elements. As such, the printheads and drop ejector array devices that are covered by the claims listed below are not limited to those having heating elements as actuators.

The invention has been described in detail with particular reference to certain preferred embodiments thereof, but it will be understood that variations and modifications can be effected within the spirit and scope of the invention.

The invention claimed is:

1. A method of operating an inkjet printhead having a first drop ejector array including m groups of n drop ejectors connected to a first power bus line and a second drop ejector array including m groups of n drop ejectors connected to a second power bus line, the first drop ejector array and the second drop ejector array being alternatingly disposed along an array direction, the method comprising:

sending print data to the printhead;

selectively firing according to the print data a first set of drop ejectors of the first drop ejector array, the first set of the first array comprising a single member of each group of drop ejectors of the first drop ejector array;

then selectively firing according to the print data a first set of drop ejectors of the second drop ejector array, the first set of the second array comprising a single member of each group of drop ejectors of the second drop ejector array;

then selectively firing according to the print data a second set of drop ejectors of the first drop ejector array, the second set of the first array comprising a different single member of each group of drop ejectors of the first drop ejector array;

then selectively firing according to the print data a second set of drop ejectors of the second drop ejector array, the second set of the second array comprising a different single member of each group of drop ejectors of the second drop ejector array;

then continuing to alternately selectively fire according to the print data drop ejectors belonging to sets of drop ejectors of the first drop ejector array and the second drop ejector array until selective firing according to the print data of each drop ejector in all m groups in the first drop ejector array and the second drop ejector array has been completed.

2. The method of claim 1, wherein a driving voltage applied to a voltage input terminal for firing the drop ejectors is determined based on a threshold ejection voltage corresponding to firing only the drop ejector nearest to the voltage input terminal.

3. The method of claim 1, wherein a driving voltage applied to a voltage input terminal for firing the drop ejectors is determined based on a threshold ejection voltage corresponding to firing an entire set of drop ejectors that are farthest from the voltage input terminal.

* * * * *